US009334736B2

(12) United States Patent
Wheeler et al.

(10) Patent No.: US 9,334,736 B2
(45) Date of Patent: May 10, 2016

(54) ROTARY FLUID MACHINE OPERABLE AS A MOTOR OR A PUMP

(71) Applicant: Greystone Technologies Pty Ltd, Welshpool (AU)

(72) Inventors: Daryl Wheeler, Silver Sands (AU); Justin Wade Erwin, Houstan, TX (US); Timothy Donald Burns, Sr., McAlester, OK (US)

(73) Assignee: Greystone Technologies Pty Ltd, Welshpool (AU)

( * ) Notice: Subject to any disclaimer, the term of this patent is extended or adjusted under 35 U.S.C. 154(b) by 75 days.

(21) Appl. No.: 14/149,571

(22) Filed: Jan. 7, 2014

(65) Prior Publication Data

US 2014/0140880 A1 May 22, 2014

Related U.S. Application Data

(63) Continuation of application No. PCT/US2012/000822, filed on Jul. 6, 2012.

(60) Provisional application No. 61/505,625, filed on Jul. 8, 2011, provisional application No. 61/608,844, filed on Mar. 9, 2012.

(51) Int. Cl.
*F03C 4/00* (2006.01)
*F04C 2/00* (2006.01)
(Continued)

(52) U.S. Cl.
CPC ..... *F01C 1/3566* (2013.01); *F01C 1/348* (2013.01); *F01C 21/0809* (2013.01);
(Continued)

(58) Field of Classification Search
CPC ..... F01C 1/3566; F01C 1/3442; F01C 1/348; F01C 21/0836; F01C 21/106; F01C 21/108; F04C 2/348; F04C 2/3566; F04C 2240/10; F04C 2240/20; F04C 2240/60; F04C 2240/603
USPC ..... 418/167, 173–174, 177, 187, 259, 418/260–261
See application file for complete search history.

(56) References Cited

U.S. PATENT DOCUMENTS 1,269,937 A 6/1918 Hutsell
1,364,438 A * 1/1921 Johnson ..... 418/177
(Continued)

FOREIGN PATENT DOCUMENTS

DE 29513194 11/1995
GB 1280610 8/1972
(Continued)

OTHER PUBLICATIONS

International Search Report for Application No. PCT/AU2012/000822 dated Nov. 19, 2012 (6 pages).
(Continued)

*Primary Examiner* — Theresa Trieu
(74) *Attorney, Agent, or Firm* — Michael Best & Friedrich LLP

(57) ABSTRACT

A rotary fluid machine 10 has a rotor 12, a stator 14, and a plurality of gates. The rotor 12 and stator 14 are rotatable relative to each other and arranged one inside the other to define a working chamber 18 there between. Gates 16 are supported in radial gate slots 20 formed in the rotor 12 and cyclically extend from and retract into the gate slots 20 as the rotor 12 rotates about stator 14. A plurality of demountable lobes is supported on an outer circumferential surface 24 of stator 14. The surface 24 forms a surface of the working chamber 18. Circumferential surface 24 is composed of an intermediate surface 48 which extends in an axial direction and opposite curved surfaces 46. The gate 16 has opposite rounded corners 130 separated by an axial planar surface 132. The shape and configuration of the gate 16 and corresponding is made to match that of the outer circumferential surface 24 so that when the axial surface 132 lies substantially adjacent and parallel to intermediate surface 48 each of the curved surfaces 130 lie closely adjacent to and substantially parallel with the concavely curved surfaces 46.

27 Claims, 33 Drawing Sheets

(51) Int. Cl.

| | |
|---|---|
| ***F04C 18/00*** | (2006.01) |
| ***F01C 1/356*** | (2006.01) |
| ***F01C 1/348*** | (2006.01) |
| ***F04C 2/348*** | (2006.01) |
| ***F04C 2/356*** | (2006.01) |
| ***F01C 21/08*** | (2006.01) |
| ***F01C 21/10*** | (2006.01) |

(52) U.S. Cl.

CPC ..... *F01C 21/0836* (2013.01); *F01C 21/106* (2013.01); *F01C 21/108* (2013.01); *F04C 2/348* (2013.01); *F04C 2/3566* (2013.01); *F04C 2240/10* (2013.01); *F04C 2240/20* (2013.01); *F04C 2240/603* (2013.01)

(56) References Cited

U.S. PATENT DOCUMENTS

| | | | | | |
|---|---|---|---|---|---|
| 3,134,335 | A | | 5/1964 | Jensen | |
| 3,244,157 | A | | 4/1966 | Tanferna et al. | |
| 3,289,543 | A | * | 12/1966 | Wolfe | 418/174 |
| 5,073,097 | A | * | 12/1991 | Pipalov | 418/175 |
| 5,597,295 | A | * | 1/1997 | Pipaloff | 418/177 |
| 2001/0046448 | A1 | | 11/2001 | Dyktynski et al. | |

FOREIGN PATENT DOCUMENTS

| | | | | | |
|---|---|---|---|---|---|
| GB | 1286010 | A | * | 8/1972 | F01C 9/00 |
| WO | 9816744 | | | 4/1998 | |
| WO | 2011088596 | | | 7/2011 | |

OTHER PUBLICATIONS

Rohner, P., "Industrial Hydraulic Control: a Textbook for Fluid Power Technicians," 1995, 4th ed., ISBN 0-471-33524-X, pp. 36-37.

Supplemental Search Report and Search Opinion from the European Patent Office for European Application No. 12811969.0 dated Mar. 24, 2015 (5 pages).

* cited by examiner

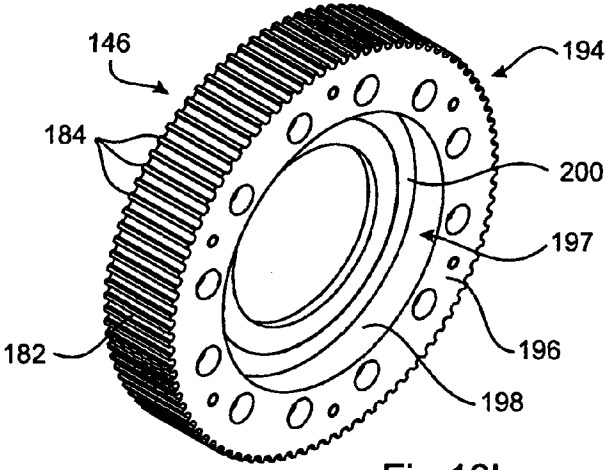
Fig 13b
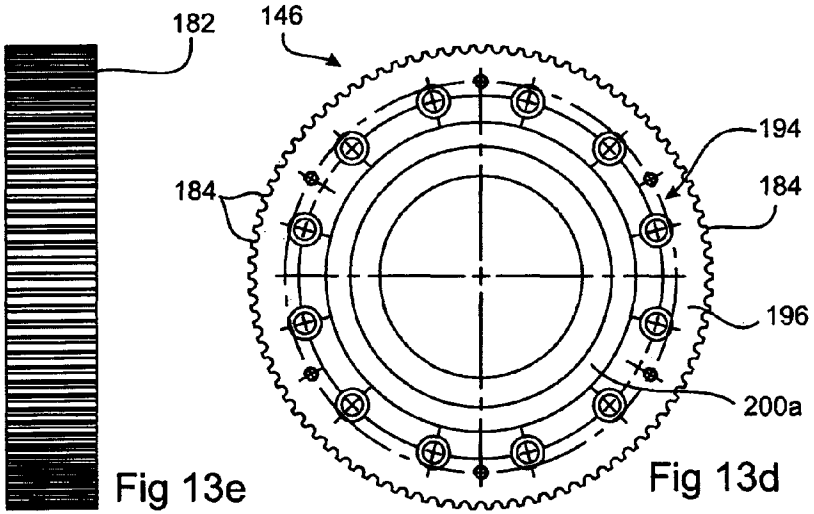
Fig 13d
Fig 13e
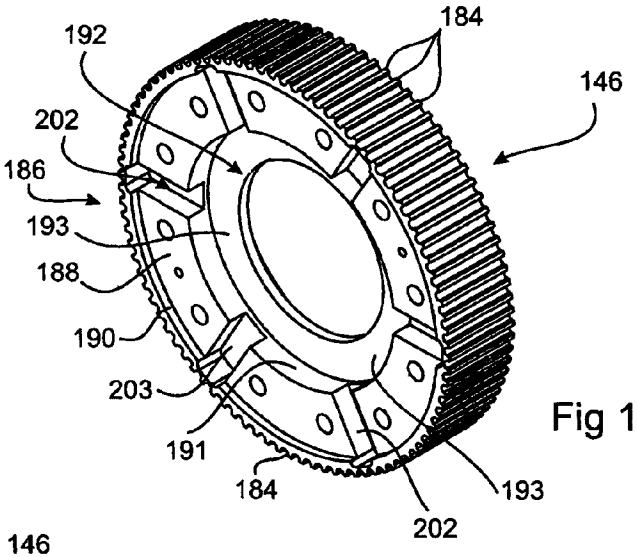
Fig 13a
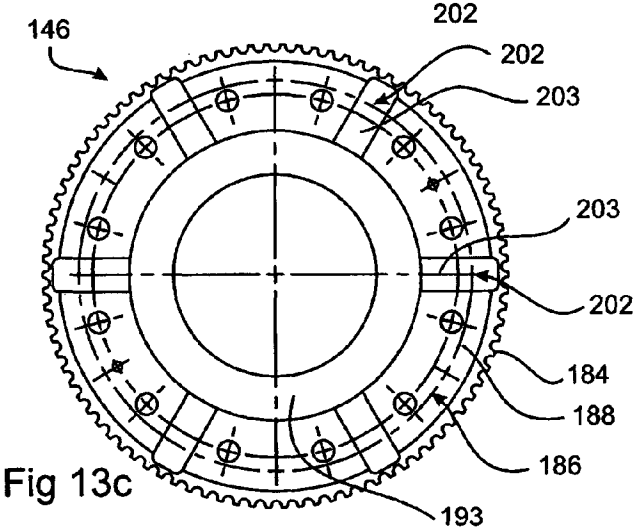
Fig 13c 16s
135s 126s
330
124s
135s
126s 332
334

126s
124s
336

130s
132s
124s
130s

ROTARY FLUID MACHINE OPERABLE AS A MOTOR OR A PUMP

CROSS-REFERENCE TO RELATED APPLICATIONS

This application is a continuation of and claims priority to International Patent Application No. PCT/AU2012/000822 filed Jul. 6, 2012, which claims priority to U.S. Provisional Patent Application No. 61/505,625 filed Jul. 8, 2011 and U.S. Provisional Patent Application No. 61/608,844 filed Mar. 9, 2012, the entire content of each of which is hereby fully incorporated by reference.

FIELD OF THE INVENTION

The present invention relates to a rotary fluid machine, and in particular, but not exclusively to a rotary fluid machine that may be operated as either a pump or a motor.

BACKGROUND OF THE INVENTION

One type of rotary fluid machine comprises a rotor and a stator which together defined a working chamber. A number of lobes are formed on one of the rotor and the stator, with a plurality of gates being supported by the other. Inlet and outlet ports are provided on opposite sides of each lobe to allow fluid to flow into and out of the working chamber. When the machine acts a motor, high pressure fluid is fed into the machine and enters the working chamber through the inlet ports. The working chamber is divided into sub-chambers between adjacent gates. The fluid exerts pressure on the gates causing the rotor to rotate. As this rotation occurs, eventually the fluid in a sub chamber is brought into fluid communication with an outlet port and vented through the machine. While this is occurring, high pressure fluid continues to enter the working chamber through the inlet ports and exerts pressure on other gates to maintain relative rotation between the rotor and stator.

When used as a pump, another machine provides torque to the rotor to cause relative rotation between the rotor and stator. As this occurs, the gates displace fluid in the pump forcing the fluid to flow through outlet ports and create a relative lower pressure state drawing further fluid through inlet ports into the working chamber.

Numerous factors govern the efficiency and reliability of fluid rotary machines. Machine performance and reliability is also substantially affected by the nature of the fluid passing through the machine. For example, fluids passing through the machine which contain abrasive products and/or corrosive substances are often problematic.

SUMMARY OF THE INVENTION

In one aspect there is provided a rotary fluid machine comprising:

first and second bodies, the bodies being rotatable relative to each other and arranged one inside the other to define at least one working chamber there between;

at least one gate supported by the first body, each gate having: a planar axial surface and respective rounded corners at each end of the axial surface;

the second body comprising a circumferential surface forming a surface of the working chamber, the circumferential surface having an intermediate surface extending in an axial direction and contiguous curved surfaces on each side of the intermediate surface and extending in a radial direction to form with the intermediate surface a U shaped channel, wherein when the planar axial surface is adjacent the intermediate surface, the rounded corners and the curved surfaces lie closely adjacent to and substantially parallel with each other.

In one embodiment each gate is arranged to cyclically extend from and retract into the first body in a radial direction as one body rotates relative to the other body.

In one embodiment each of the curved surfaces and the rounded corners smoothly curve through 90 degrees.

In one embodiment the rounded corners of the gate are convexly curved and the curved surfaces of the second body are concavely curved.

In one embodiment the second body comprises a stator of the machine and is rotationally fixed and the first body comprises a rotor of the machine and rotates relative to the stator.

In one embodiment the second body is disposed inside the first body.

In one embodiment the or each gate comprises a wiper and a gate seal system supported by the wiper, the gate seal system arranged to form a dynamic seal against the circumferential surface of the second body.

In one embodiment the wiper is provided with the planar axial surface and the respective rounded corners and the gate seal system comprises one or more sealing bands supported in the wiper and extendable from the planar axial surface and respective rounded corners.

In one embodiment the or each sealing band is resilient biased to extend from the planar axial surface and respective rounded corners.

In one embodiment the or each sealing band is axially and radially movable relative to the wiper.

In one embodiment each sealing band comprises a flexible strip of material.

In one embodiment each sealing band comprise a straight length and curved portions at each end of the straight length, and a plurality of slots formed in the curved portions to facilitate flexing of the curved portions in a plane containing a corresponding sealing band.

In one embodiment each sealing band comprise a plurality of slots formed in the straight length.

In one embodiment the gate seal system comprise at least two sealing bands juxtaposed face to face, each sealing band being provided with a plurality of slots to facilitate flexing of the sealing bands, and wherein the sealing bands and slots are arranged so that there is no direct fluid flow path between opposite sides of the gate seal system through the slots.

In one embodiment gate is provided with one or more radially extending channels to enable fluid flow between radially opposite ends of the gate.

In one embodiment the radially extending channels extend through the gate and open onto the radially opposite ends of the gate.

In one embodiment the radially extending channels are formed on one side surface of the gate.

In one embodiment the rotary fluid machine comprises a gate displacement system operable to displace the gate in a radial direction upon rotation of the first body relative to the second body.

In one embodiment the gate displacement system comprises for each gate, two gate links coupled one on each side of the gate, and cam surfaces arranged to guide the gate links to move in the radial direction as the first and second bodies rotate relative to each other, the gate links and the cam surfaces being disposed outside of the working chamber.

In one embodiment each gate link comprises two cam followers arranged to engage respective cam surfaces.

In one embodiment each gate link is slidably retained within the first body and coupled by a pin to a corresponding gate.

In one embodiment the first body comprises a radially extending pin slot for each pin, each pin extending axially through a corresponding pin slot to couple with a corresponding link, and a pin slot sealing arrangement operable to form a substantially seal about the pin slot.

In one embodiment each gate link comprises a leg coupled at one end to corresponding pin and wherein the cam followers are co-axially coupled near an opposite end of the leg.

In one embodiment the first body is provided with a link recess for each leg, each link recess being closed at one end and opened at an opposite end, wherein each leg is slidably retained in a respective link recess.

In one embodiment the cam surfaces comprise, on each side of the working chamber, first and second cam surfaces fixed to the second body and axially offset relative to each other.

In one embodiment the first body is provided with a link recess for each link, each link recess being formed inboard of a radially inner most and a radially outer most edge of the first body, wherein each link is slidably retained in a respective link recess.

In one embodiment two cam followers are rotatable coupled on respective axles on a same side of the link.

In one embodiment the pin slot sealing arrangement comprises first and second seal plates arranged face to face wherein a the first seal plate is coupled to and moves with the link, the first seal plate further provided with a hole through which the pin extends; and a the second seal plate is coupled to and fixed relative to the first body, the second seal plate being provided with a slot being in registration with a respective pin slot formed in the first body.

In one embodiment the cam surfaces comprise, on each side of the working chamber, opposite sides of a continuous cam rail.

In one embodiment the wherein the first body comprises an intermediate housing provided with a plurality of blind gate slots within which respective gates reciprocate.

In one embodiment the rotary fluid machine comprises first and second end caps coupled at axially opposite ends of the intermediate housing, wherein the gate links are disposed in the end caps.

In one embodiment the rotary fluid machine comprises a mechanical fluid seal on each side of the working chamber to provide a substantial fluid seal between the working chamber and the end caps.

In one embodiment the mechanical fluid seal comprises on each side of the working chamber a first ring fixed to first body and a second ring fixed to the second body, the rings being provided with polished surfaces biased into contact with each other.

In one embodiment the second body comprises one or more pairs of ports, each pair of ports comprising a fluid inlet port and a fluid outlet port and, one or more lobes demountable coupled to the second body and configured to project from the circumferential surface of the second body, each lobe: located between the inlet and outlet ports in a pair of ports; and, comprising a central portion and at least one ramp extending from each side of the central portion to the circumferential surface, the at least one ramp having a ramp surface that provides a transition between the circumferential surface to an upper surface of the central portion.

In one embodiment the ports are provided with chamfered surfaces leading to the circumferential surface and the ramps seat on the chamfered surfaces.

In one embodiment each lobe comprises two ramps extending from each side of the central portion.

In one embodiment the central portion and the ramps are formed as separate parts and interfitted with each other when a corresponding lode is coupled to the body.

In one embodiment the central portion extends in an axial direction across the circumferential surface.

In one embodiment the lobes are disposed in an axial direction between the contiguous curved surfaces.

In one embodiment the rotary fluid machine comprises a coupling mechanism for demountably coupling each of the lobes to the body, the coupling mechanism comprising a locking member that engages a corresponding lobe at a location radially inside of the circumferential surface.

In one embodiment each lobe comprises one or more lugs extending in a radial inward direction and configured for engagement with the locking member.

In one embodiment wherein each gate slot comprises two spaced apart and parallel flat surfaces which face each other and extend at one end to an inner circumferential surface of the intermediate housing, and a contiguous arcuate portion extending between respective distant ends of the flat surfaces forming a blind end of the gate slot.

In one embodiment the contiguous arcuate surface has a diameter greater than a transverse distance between the flat surfaces.

In one embodiment the flat surfaces are separated by a transverse distance W and the acuate portion has a diameter D and $W \leq D \leq 5W$.

In a second aspect the invention provides a body for a fluid rotary machine, the body comprising:

one or more pairs of ports, each pair of ports comprising a fluid inlet port and a fluid outlet port; and, one or more lobes demountable coupled to the body and configured to project from a circumferential surface of the body, each lobe: being located between the inlet and outlet ports in a pair of ports; and, comprising a central portion and at least one ramp extending from each side of the central portion to the circumferential surface, the at least one ramp having a ramp surface that provides a transition between the circumferential surface to an upper surface of the central portion.

In one embodiment portions of the circumferential surface of the body on either side of a lobe have a constant radius.

In one embodiment a portion of the circumferential surface underlying the central portion is flat.

In one embodiment the ports are provided with chamfered surfaces leading to the circumferential surface and the at one ramps seat on the chamfered surfaces.

In one embodiment each lobe comprises two ramps extending from one side of the central portion and two ramps extending from an opposite side of the central portion.

In one embodiment respective ramps bridge across the inlet and outlet ports in a pair of ports.

In one embodiment the central portion and the ramps are formed as separate parts and interfitted with each other when a corresponding lode is coupled to the body.

In one embodiment the central portion extends in an axial direction across the circumferential surface.

In one embodiment the upper surface of central portion is a continuous surface.

In one embodiment the circumferential surface of the body comprises an intermediate surface extending in an axial direction and contiguous curved surfaces, one on each side of the intermediate surface and extending in a radial direction, and wherein the lobes are disposed in an axial direction between the contiguous curved surfaces.

In one embodiment the contiguous curved surfaces are provided on flanges extending radially of and about the body.

In one embodiment the continuous surface on the central portion has a curvature the same as that of an outer circumferential surface of the flanges.

In one embodiment the body comprises a coupling mechanism for demountably coupling each of the lobes to the body, the coupling mechanism comprising a locking member that engages a corresponding lobe at a location radially inside of the circumferential surface.

In one embodiment each lobe comprises one or more lugs extending in a radial inward direction and configured for engagement with the locking member.

In one embodiment each lug comprises a hole through which the locking member passes to engage the lobe.

In a third aspect the invention provides a rotary fluid machine comprising:

a first body;

a second body comprising the body accordance with the second aspect, the first and second bodies being rotatable relative to each other and arranged one inside the other to define at least one working chamber there between; and, at least one gate, the or each gate movable within respective gate slots formed in the first body, each gate being movable to wipe across the circumferential surface of the second body and the lobes when the bodies rotate relative to each other.

In one embodiment the second body is a stator of the machine and lies inside of the first body.

In one embodiment each gate comprises a planar axial surface and respective rounded corners at each end of the planar axial surface and wherein when the planar axial surface is adjacent the intermediate surface, the rounded corners and the curved surfaces lie closely adjacent to and substantially parallel with each other.

In a fourth aspect the invention provides a body for a fluid rotary machine, the body forming a rotor or a stator of the machine and comprising:

one or more radially extending blind gate slots that open onto a circumferential surface of the body, each gate slot having two spaced apart and parallel flat surfaces which face each other and extend at one end to the circumferential surface and a contiguous arcuate portion extending between respective distant ends of the flat surfaces forming a blind end of the gate slot.

In one embodiment the contiguous arcuate surface has a diameter greater than a transverse distance between the flat surfaces.

In one embodiment the flat surfaces are separated by a transverse distance W and the acuate portion has a diameter D and $W \leq D \leq 5W$.

In one embodiment the body comprises: an intermediate housing provided with the blind gate slots; and, two face plates one disposed on either side of the intermediate housing, each face plate provided with a plurality of pin slots formed inboard of radial inner and radial outer edges of the face plates and passing through a thickness of the face plates, the pin slots in the face plates positioned to register with the blind slots in the intermediate housing.

In one embodiment each face plate is provided with a plurality of seals, each seal circumscribing a corresponding pin slot in the face plate on a side distant the intermediate housing.

In one embodiment the body comprises two end caps, one adjacent each face plate, and wherein an outer circumferential surface of the face plates is located radially inward of respective outer circumferential surfaces of the intermediate housing and the end caps.

In one embodiment wherein each end cap is provided with a plurality of radially extending link recesses on a side adjacent the face plates, the radially extending link recesses being closed at a radial outer end and open at a radial inner end.

In one embodiment the body comprises an intermediate housing provided with the blind gate slots and first and second end caps coupled at axially opposite ends to the intermediate housing, each end cap being provided a plurality of link recesses formed inboard of a radially inner most and a radially outer most edge of a corresponding end cap.

In one embodiment each end cap is provided with a plurality of pin slots formed inboard of radial inner and radial outer edges of a corresponding end cap, the pin slots in the end caps positioned to register with the blind slots in the intermediate housing and opening onto respective link recesses.

In one embodiment the body comprises a respective sealing arrangement associate with each link recess and respective pin slot, each sealing arrangement comprising first and second seal plates arranged face to face wherein the first seal plate arranged to move within a corresponding link recess, the first seal plate further provided with a through hole configured to receive a pin, and the second seal plate is fixed within the corresponding link recess, the second seal plate being provided with a slot in registration with a respective pin slot of the corresponding link recess.

In a fifth aspect the invention provides a rotary fluid machine comprising:

first and second bodies, the first body being provided with one or more radial gate slots, the bodies being rotatable relative to each other and arranged one inside the other to define there between: at least one working chamber;

at least one gate movable in a radial direction within a respective radial gate slot; and, a gate displacement mechanism operable to displace the or each gate in a radial direction within a corresponding gate slot upon rotation of the first body relative to the second body;

wherein the gate displacement mechanism comprises, for each gate: two gate links coupled one on each side of the gate; and, cam surfaces arranged to guide the gate links to move in the radial direction as the first and second bodies rotate relative to each other, the gate links and the cam surfaces being disposed outside of the working chamber.

In one embodiment each gate link comprises two cam followers arranged to engage respective cam surfaces.

In one embodiment each gate link is slidably retained within the first body and coupled by a pin to a corresponding gate.

In one embodiment the first body comprises a radially extending pin slot for each pin, each pin extending axially through a corresponding pin slot to couple with a corresponding link, and a sealing arrangement operable to form a substantially seal about the pin slot.

In one embodiment each gate link comprises a leg coupled at one end to corresponding pin and wherein the cam followers are co-axially coupled near an opposite end of the leg.

In one embodiment the first body is provided with a link recess for each leg, each link recess being closed at one end and opened at an opposite end, wherein each leg is slidably retained in a respective link recess.

In one embodiment the cam surfaces comprise, on each side of the working chamber, first and second cam surfaces fixed to the second body and axially offset relative to each other.

In one embodiment the first body is provided with a link recess for each link, each link recess being formed inboard of a radially inner most and a radially outer most edge of the first body, wherein each link is slidably retained in a respective link recess.

In one embodiment two cam followers are rotatable coupled on respective axles on a same side of the link.

In one embodiment the sealing arrangement comprises first and second seal plates arranged face to face wherein a the first seal plate is coupled to and moves with the link, the first seal plate further provided with a hole through which the pin extends; and a the second seal plate is coupled to and fixed relative to the first body, the second seal plate being provided with a slot being in registration with a respective pin slot formed in the first body.

In one embodiment the cam surfaces comprise, on each side of the working chamber, opposite sides of a continuous cam rail.

In one embodiment the first body comprises an intermediate housing provided with the one or more gate slots.

In one embodiment the rotary fluid machine comprises first and second end caps coupled at axially opposite ends of the intermediate housing, wherein the gate links are disposed in the end caps.

In one embodiment the rotary fluid machine comprises a mechanical fluid seal on each side of the working chamber to provide a substantial fluid seal between the working chamber and the end caps.

In one embodiment the mechanical fluid seal comprises on each side of the working chamber a first ring fixed to first body and a second ring fixed to the second body, the ring provided with polished surfaces biased into contact with each other.

In a sixth aspect the invention provides a gate for a rotary fluid machine having first and second bodies, the first body being provided with one or more radial gate slots, the bodies being rotatable relative to each other and arranged one inside the other to define a working chamber there between, the working chamber having a circumferential surface, the gate comprising:

a wiper and a sealing system supported by the wiper and arranged to form a dynamic seal against the circumferential surface of the second body.

In one embodiment the wiper is provided with a planar axial surface and respective rounded corners at opposite ends of the planar axial surface and the sealing system comprises one or more sealing bands supported in the wiper and extendable from the planar axial surface and respective rounded corners.

In one embodiment the or each sealing band is resilient biased to extend from the planar axial surface and respective rounded corners.

In one embodiment the or each sealing band is axially and radially movable relative to the wiper.

In one embodiment each sealing band comprises a flexible strip of material.

In one embodiment each sealing band comprise a straight length and curved portions at each end of the straight length, and a plurality of slots formed in the curved portions to facilitate flexing of the curved portions in a plane containing a corresponding sealing band.

In one embodiment each sealing band comprises a plurality of slots formed in the straight length.

In one embodiment the sealing system comprise at least two sealing bands juxtaposed face to face, each sealing band being provided with a plurality of slots to facilitate flexing of the sealing bands, and wherein the sealing bands and slots are arranged so that there is no direct fluid flow path between opposite sides of the sealing system through the slots.

In one embodiment each gate is provided with one or more radially extending channels to enable fluid flow between radially opposite ends of the gate.

In one embodiment the radially extending channels extend through the gate and open onto the radially opposite ends of the gate.

In one embodiment the radially extending channels are formed on one side surface of the gate.

In a seventh aspect the invention provides a rotary fluid machine comprising:

first and second bodies, the first body being provided with one or more radial slots, the bodies being rotatable relative to each other and arranged one inside the other to define a working chamber there between;

at least one gate movable in a radial direction within a respective radial slot, each gate having a wiper disposed in the working chamber and being supported at opposite ends on respective lifters, each lifter disposed outside, and on mutually opposite sides, of the working chamber; and arranged to cooperate with one or more cam surfaces to effect reciprocating radial motion of a corresponding the gate in an associated slot; and a fluid sealing system providing a fluid seal between the working chamber and the cam surfaces.

BRIEF DESCRIPTION OF THE DRAWINGS

Embodiments of the present invention will now be described by way of example only with reference to the accompanying drawings in which:

FIGS. 13*a*-13*e* illustrate from alternate angles, an end cap incorporated in the machine;

DETAILED DESCRIPTION OF THE PREFERRED EMBODIMENTS

Figure 1:
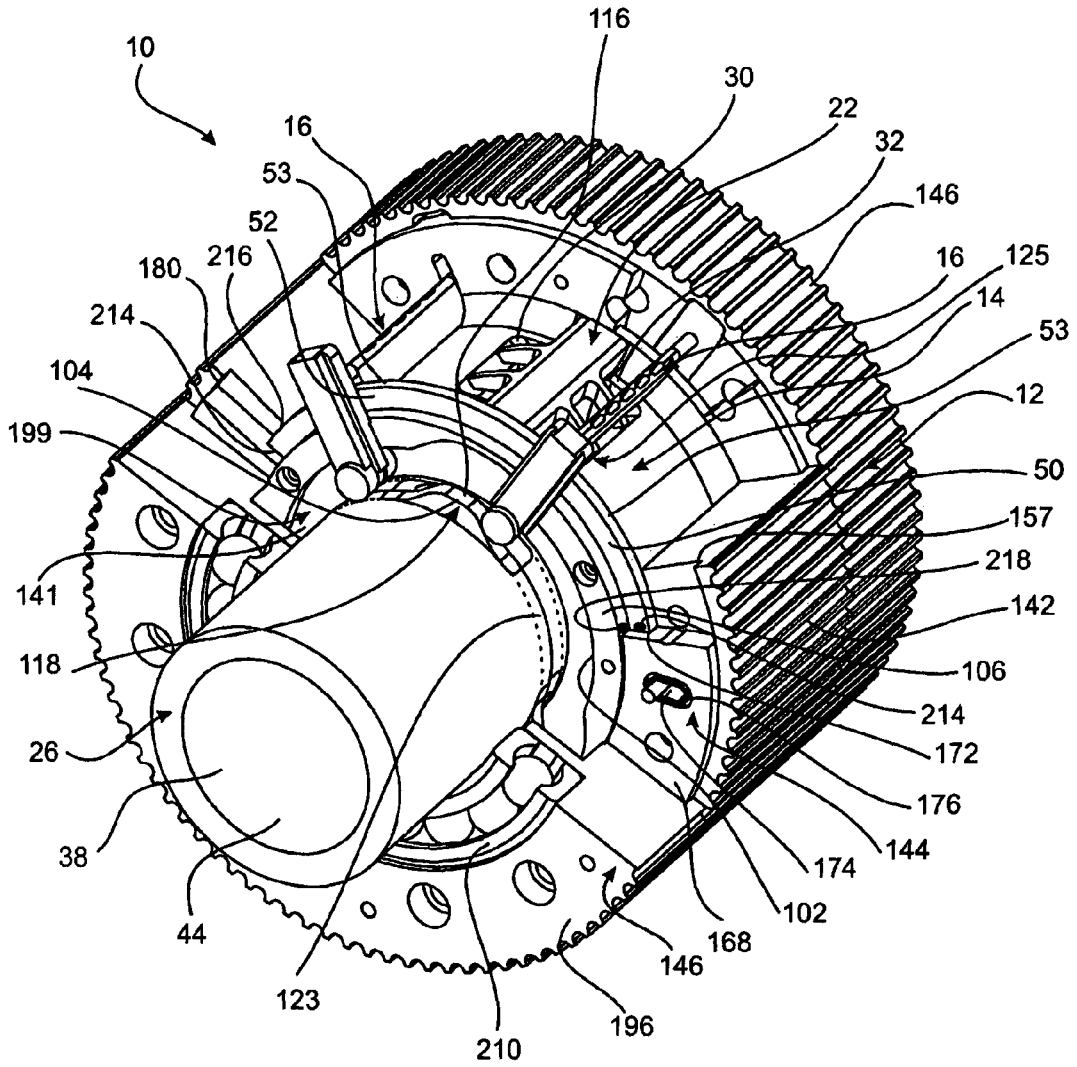
FIG. 1 is a partial cut away view of an embodiment of the machine in accordance with the present invention.

Referring to the accompanying drawings and in particular FIGS. 1-3, an embodiment of a rotary fluid machine 10 comprises a first body 12, a second body 14, and a plurality of gates 16*a*-16*f* (hereinafter referred to in general as "gate(s) 16"). In this embodiment, the first body 12 is a rotor while the second body 14 is a stator. The rotor 12 and stator 14 are rotatable relative to each other and arranged one inside the other to define a working chamber 18 there between. Gates 16 are supported in radial gate slots 20 formed in the rotor 12 and cyclically extend from and retract into the gate slots 20 as the rotor 12 rotates about stator 14. A plurality of demountable lobes 22*a*-22*c* (hereinafter referred to in general as "lobe(s) 22") is supported on an outer circumferential surface 24 of stator 14. The surface 24 forms a surface of the working chamber 18. As rotor 12 rotates the gates 16 wipe across the outer circumferential surface 24 and lobes 22. This causes displacement of fluid through the working chamber 18 and machine 10.

Fluid is directed through the machine 10 via: a central conduit 26 which forms part of the stator 14; a manifold 28 disposed in the conduit 26; and, a plurality of inlet ports 30*a*, 30*b*, 30*c* (hereinafter referred to in general as "inlet port(s) 30") and outlet ports 32*a*, 32*b*, 32*c* (hereinafter referred to in general as "outlet port(s) 32") provided in stator 14. The gates 16 and lobes 22 are arranged so that at any one time one gate 16 is wiping across the stator 14 at a location between an inlet port 30 and an outlet port 32 located between pairs of adjacent lobes 22. This results in a division of the working chamber 18 into alternating inlet and outlet chambers 34 and 36 respectively.

Flow of fluid through the machine 10 is essentially axial. In this regard fluid enters the machine 10 through an inlet end 38 of conduit 26, and is uniformly divided by manifold 28 to provide substantially equal fluid flows in terms of pressure and volume into each of the inlet ports 30. This fluid then flows into the corresponding inlet chambers 34. Assuming that the machine 10 is being operated as a motor, the fluid entering inlet end 38 is at a relative high pressure. This fluid flows into the inlet chambers 34 and acts against the gates 16. The outlet chambers 36 on an opposite side of each of gate 16 are vented via outlet ports 32 to a relative low pressure. Accordingly a pressure differential exists across adjacent inlet and outlet chambers 34 and 36. This causes rotation of rotor 12 in (with reference to FIG. 2) an anti-clockwise direction about stator 14. Hose couplings C1 and C2 are screwed into the inlet 38 and outlet 40 to facilitate attachment of fluid hoses (not shown) to the machine 10.

Figure 2:
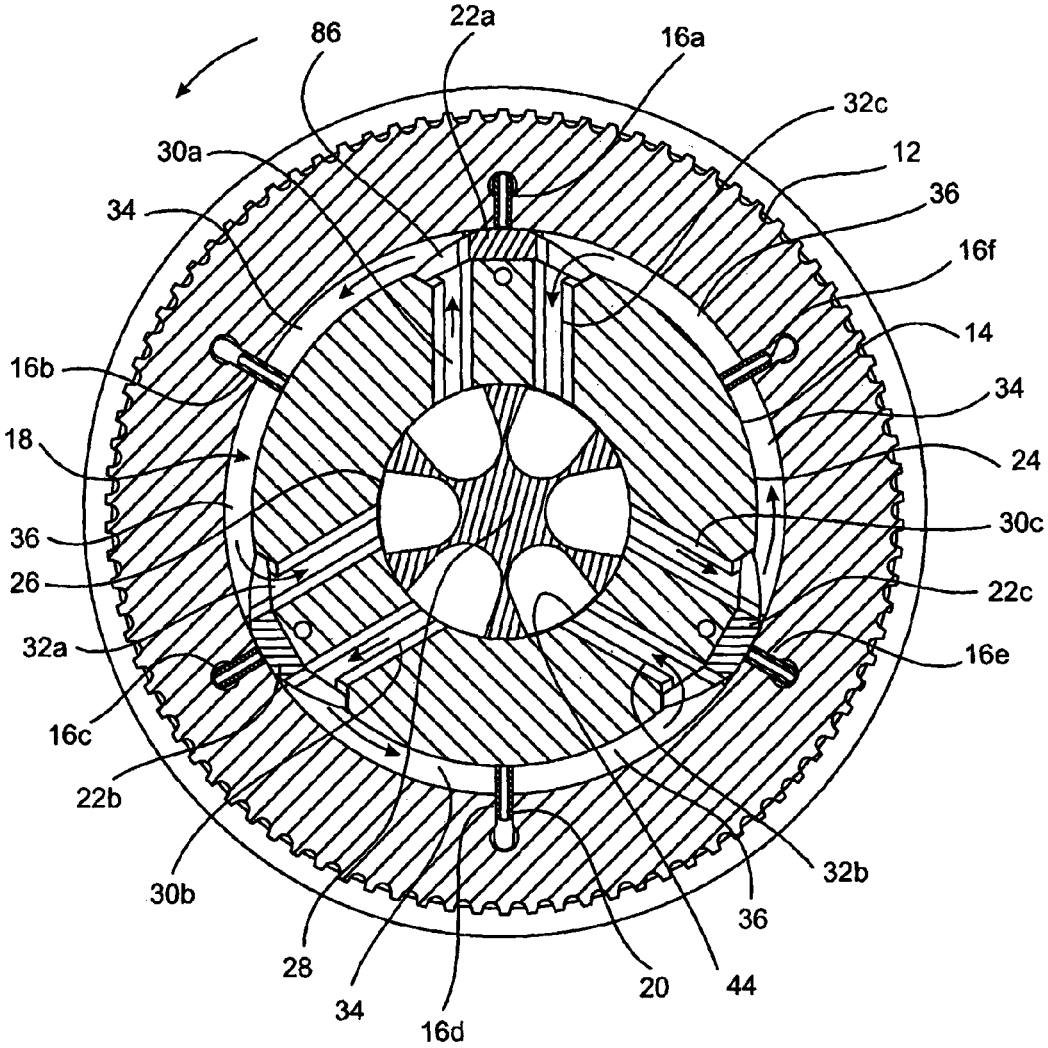
FIG. 2 is a radial section view of the machine shown in FIG. 1.

To assist in describing the operation of the machine 10 consider, with reference to FIG. 2 a high pressure fluid flowing through inlet port 30*a* into the chamber 34 and acting on gate 16*b*. The pressure differential across gate 16*b* causes rotor 12 to rotate in an anti-clockwise direction moving gate 16*b* toward outlet port 32*a*. Thus fluid in advance of gate 16*b* is vented to the outlet port 32*a*. Simultaneously gate 16*a* is rotated toward and indeed past inlet port 30*b*. By the time gate 16*b* passes outlet port 32*a* the gate 16*a* has been rotated past inlet port 30*a*. Thus high pressure fluid is now able to act on gate 16*a* to continue the rotation of rotor 12 while fluid in between gate 16*a* and 16*b* flows through outlet port 32*a*.

The above describes the general operation of machine 10 as a motor. Machine 10 is able to operate as a pump by applying torque to the rotor 12 causing it to rotate relative to stator 14.

Figure 4:
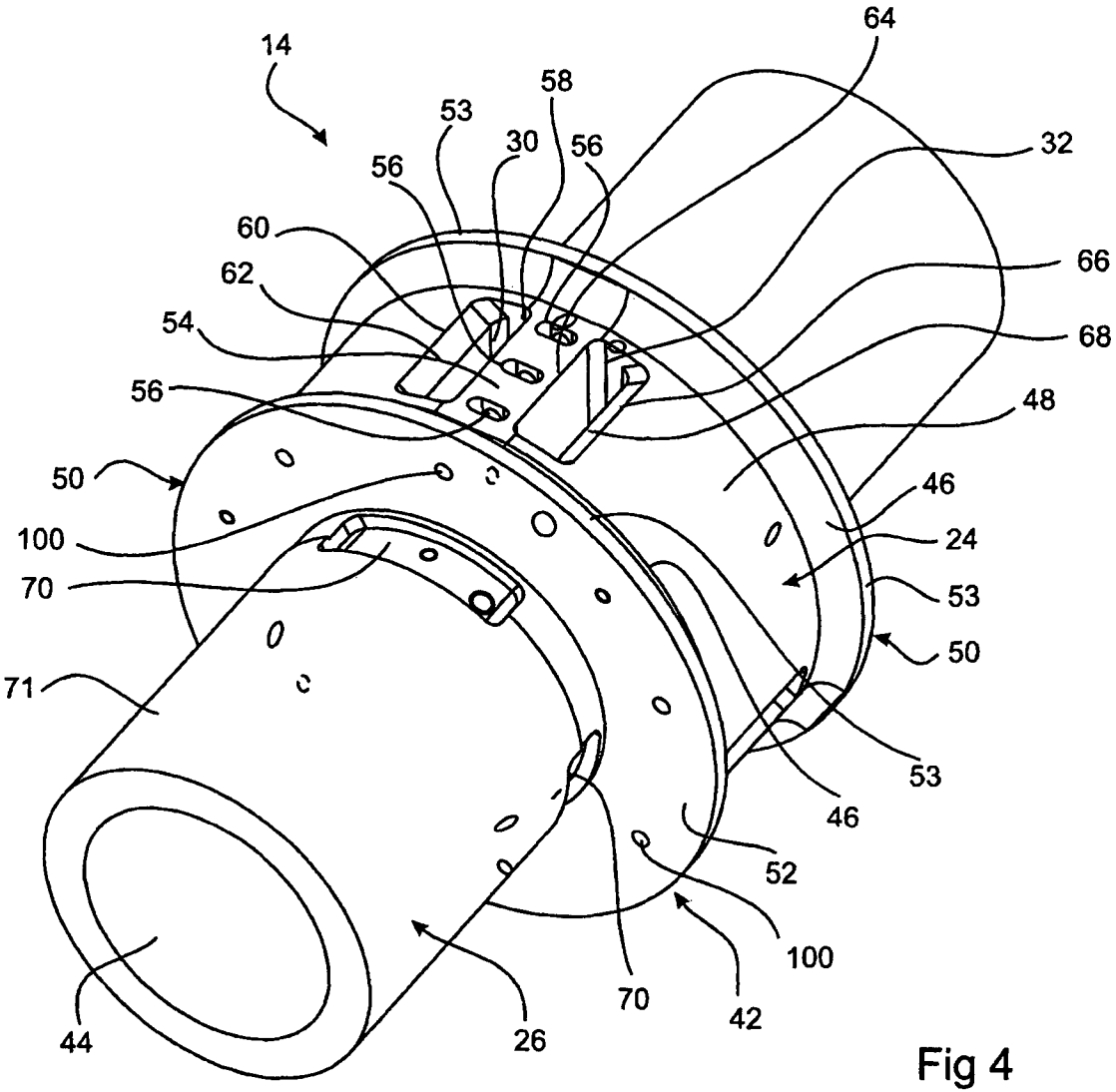
FIG. 4 is an isometric view of a stator incorporated in the machine shown in FIGS. 1-3.
Figure 5:
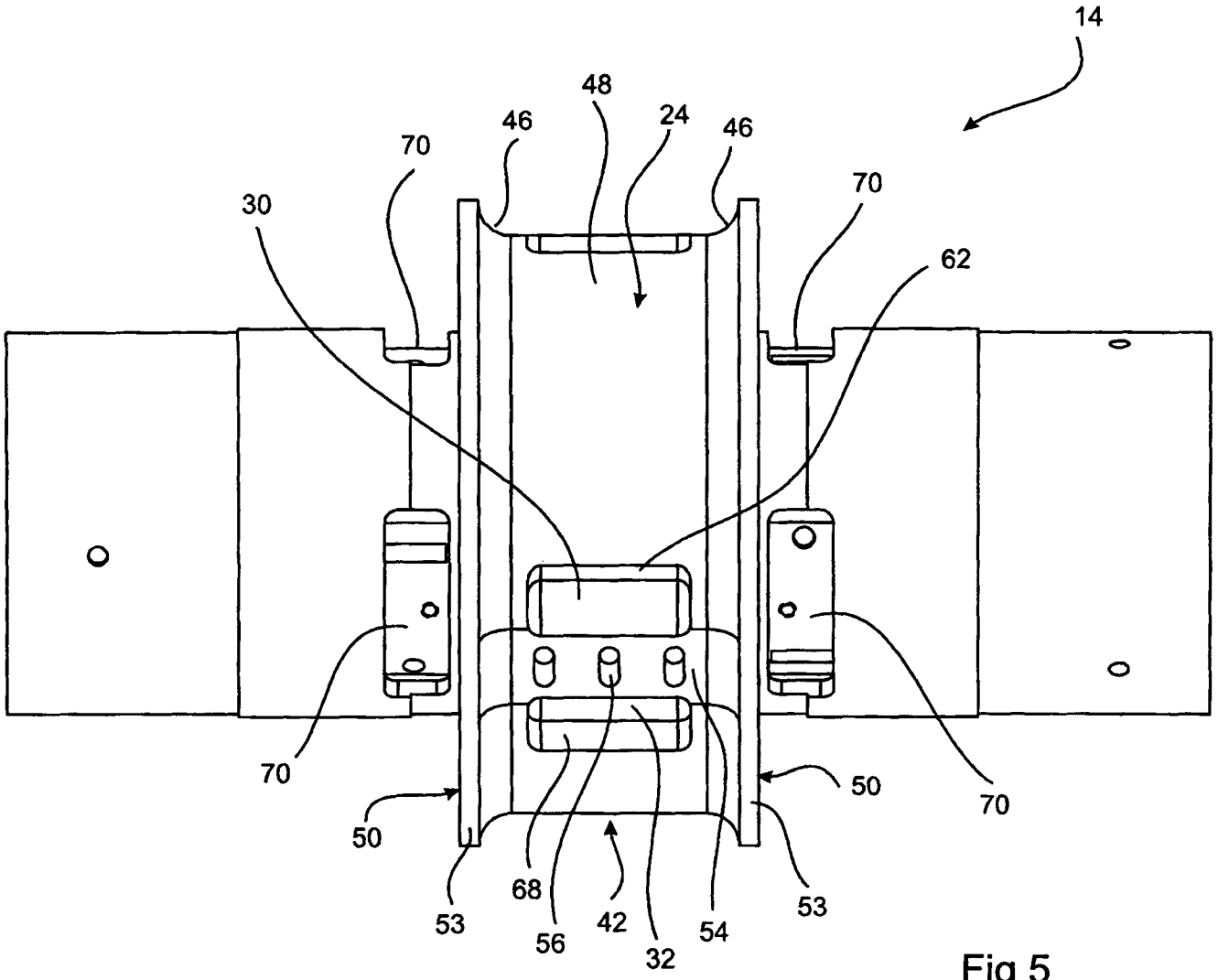
FIG. 5 is a side view of the stator shown in FIG. 4.
Figure 6C:
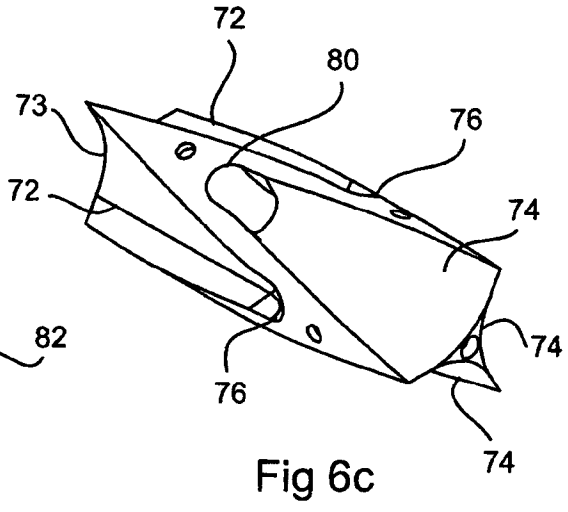
FIG. 6*a*-6*f* are views from alternate angles and ends of a manifold incorporated in the machine shown in FIG. 1.
Figure 6F:
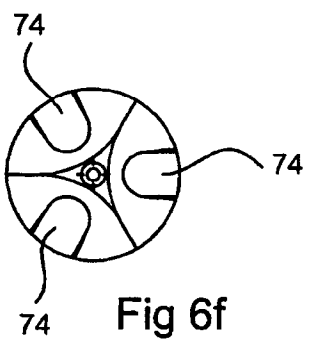
Figure 6B:
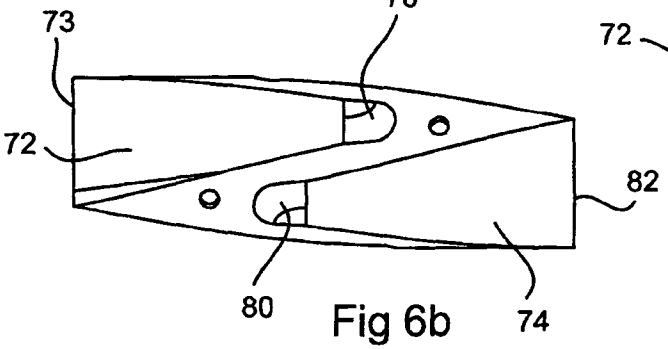
Figure 6E:
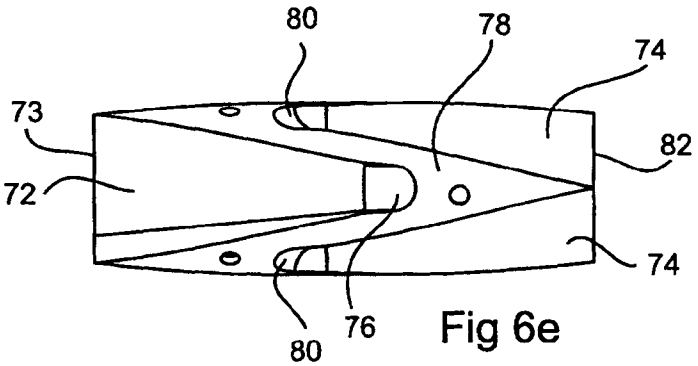
Figure 6A:
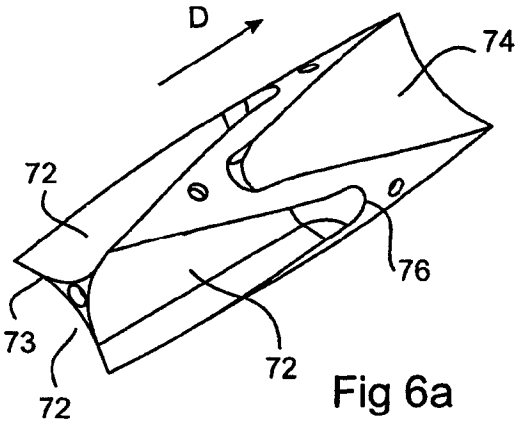
Figure 6D:
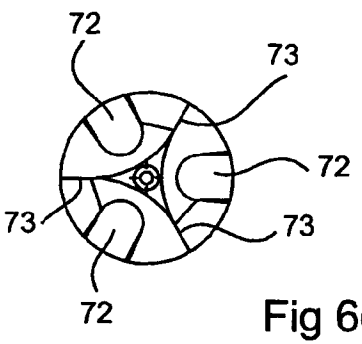

Each of the components, structures and systems of machine 10 will now be described in greater detail starting with the stator 14. With particular reference to FIGS. 4 and 5, stator 14 comprises a hub 42 formed coaxial with the central conduit 26. The outer circumferential surface 24, inlet ports 30 and outlet ports 32 are formed on or in the hub 42. The inlet and outlet ports 30, 32 extend radially and open onto both the circumferential surface 24, and an inner circumferential surface 44 of the conduit 26. Circumferential surface 24 comprises an intermediate surface 48 which extends in an axial direction and opposite curved surfaces 46. Surfaces 46 are concavely curved and extend away from intermediate surface 48. In cross-section, the circumferential surface 24 forms a wide and relatively shallow U shaped channel with the intermediate surface 48 forming a planar bottom of the U shaped channel and the curved surfaces 46 forming rounded corners and arms of the U shaped channel, as seen most clearly in FIG. 5.

The curved surfaces 46 are formed on axial inner surfaces of respective radially extending flanges 50. The flanges 50 delimit the axial extent of hub 42. A planar surface 52 is provided on a side of each flange 50 opposite its curved surface 46. A circumferential surface 53 of constant diameter extends about each flange 50 between the curved surface 46 and the planar surface 52.

The intermediate surface 48 is of constant outer diameter between the lobes 22. However surface 48 includes a number of flat lands 54 on which the lobes are mounted. An inlet port 30 is disposed immediately adjacent one side of a corresponding land 54 with an outlet port 32 immediately adjacent an opposite side that land 54. Each land extends in an axial direction between the curved surfaces 46 and is provided with a number of radial inwardly extending holes 56.

Each inlet port 30 has an opening provided with one edge 58 forming a common edge with an adjacent land 54, and an opposite edge 60 opening onto the surface 24. The opening of port 30 adjacent edge 60 is formed with chamfered or bevelled surface 62 that slopes from the edge 60 radially inward toward the adjacent land 54.

Each outlet port 32 is also provided with an opening having a common edge 64 with land 54, and an opposite edge 66 opening onto the surface 48. A chamfered or bevelled surface 68 extends from edge 66 in a radially inward direction toward land 54.

A plurality of evenly spaced seats 70 is formed on an outer circumferential surface 71 of conduit 26 on opposite sides of hub 42. As will be explained in greater detail below, seats 70 are arranged to receive cam surfaces for operating the gates 16.

Flow of fluid through machine 10 is distributed or controlled by the manifold 28 which is installed inside conduit 26. FIGS. 6*a*-6*f* illustrate one possible form of manifold 28. The manifold 28 is in the form of a solid billet of material having three inlet flutes 72 and three outlet flutes 74. Each of the inlet flutes 72 is of the same shape and configuration and is provided at an axial outer end with an arcuate edge 73 extending for 120°. The flutes 72 reduce in cross-sectional area in a downstream direction D. An axial inward end 76 of each flute 72 is located immediately below a corresponding inlet port 30. The ends 76 lead to an outer circumferential surface 78 of the manifold 28 which is in sealing contact with the inner circumferential surface 44 of conduit 26.

The outlet flutes 74 are of identical shape and configuration to the inlet flutes 72 and are circumferentially interleaved with flutes 72. However the outlet flutes 74 are in a reverse orientation so that they increase in cross-sectional area in the downstream direction D from their respective axial inward ends 80 to an arcuate axial outer ends which terminate in arcuate edges 82 extending for 120°. Further the axial inward end 80 of each outlet flute 74 is located immediately below a corresponding outlet port 32.

Figure 3:
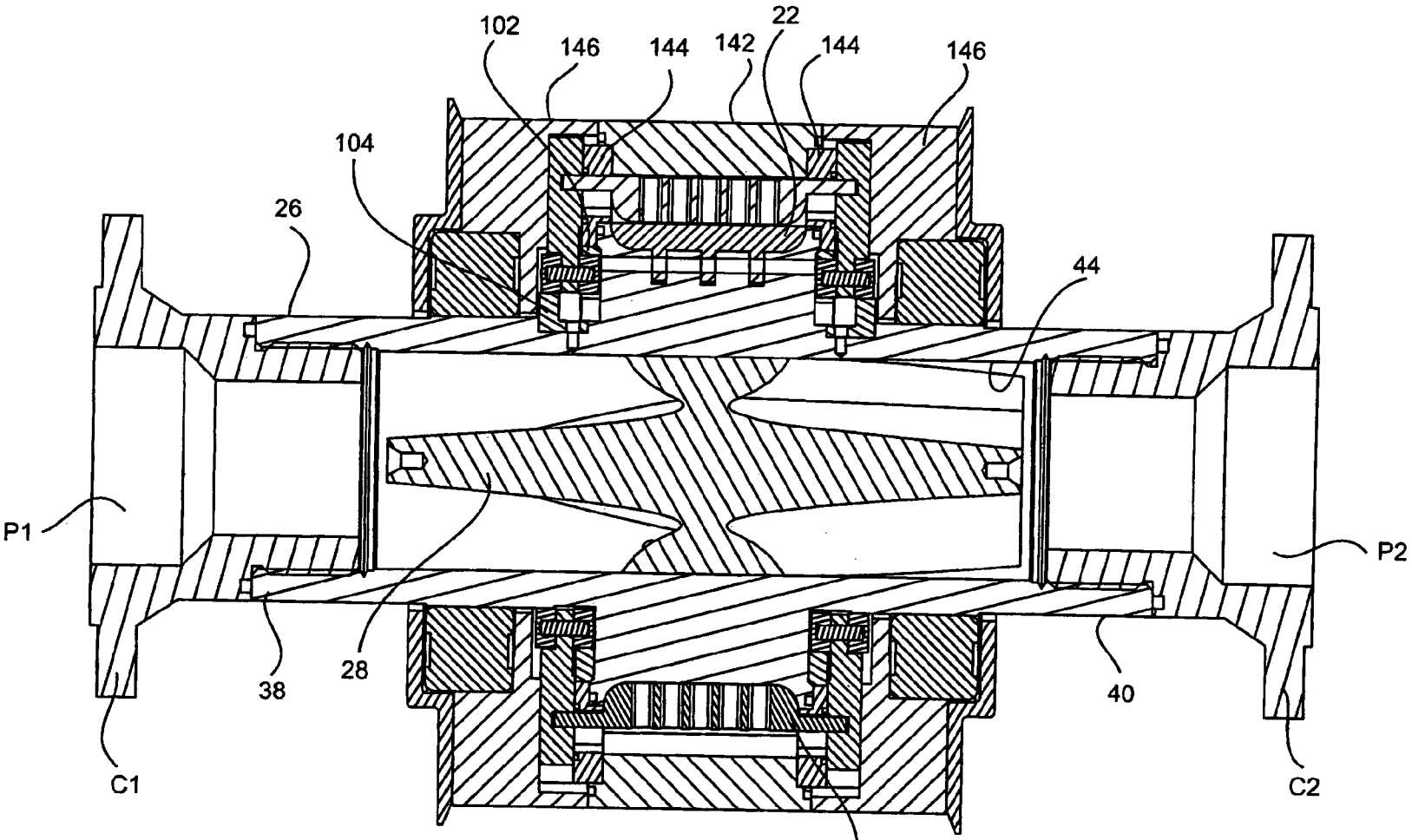
FIG. 3 is an axial cross section view of the machine shown in FIG. 1.
Figure 7A:
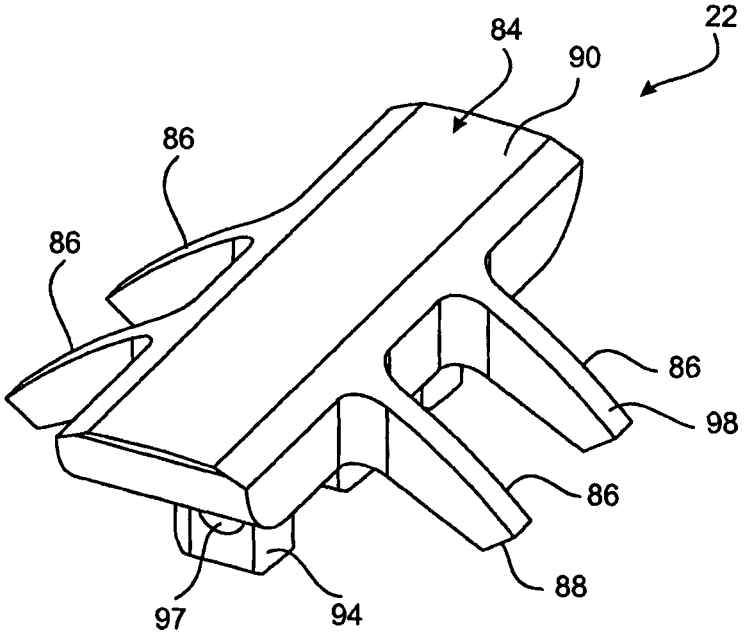
FIG. 7*a* is a perspective view from a first angle of a demountable lobe incorporated in the machine shown in FIG. 1.
Figure 7B:
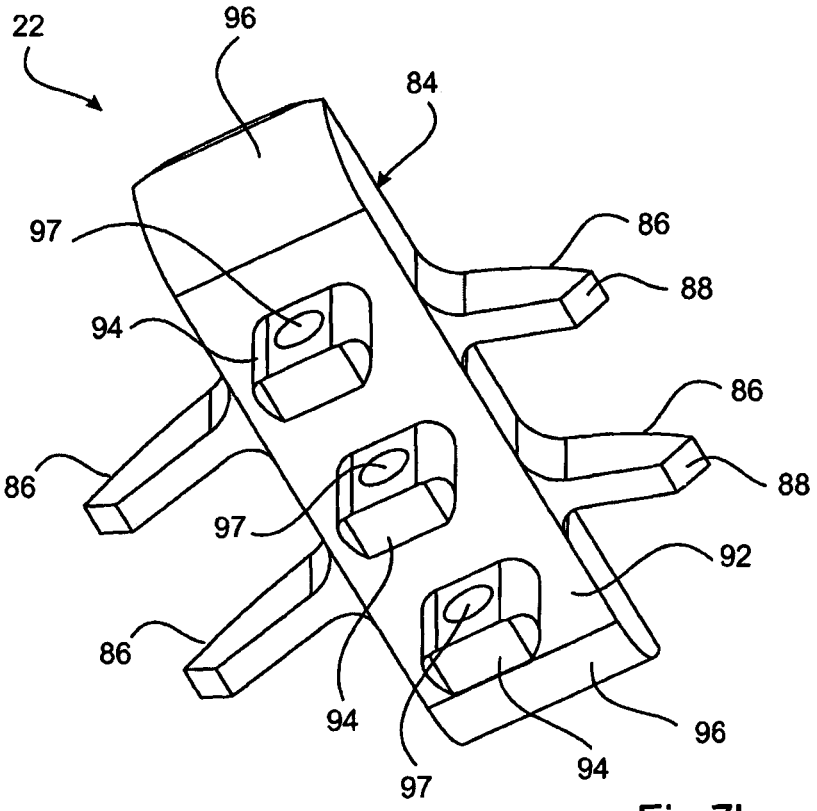
FIG. 7*b* is a further isometric view of the lobe shown in FIG. 7*a* but from an alternate angle.

The lobes 22 are shown coupled with stator 14 in FIGS. 1, 2 and 3; and, as individual components in FIGS. 7*a* and 7*b*. Each lobe 22 comprises a central portion 84 and, in this instance, two ramps or legs 86 which extend from each side of central portion 84. As shown in FIGS. 1 and 2, the ramps 86 extend across ports 30 and 32 on either side of a land 56. A surface 88 at a free end of each of the ramps 86 is bevelled or chamfered at a corresponding angle to the chamfered surfaces 60 and 68. Central portion 84 is formed with upper and lower surfaces 90 and 92. Upper surface 90 has the same curvature as the outer circumferential surface 53 on flanges 50. Arcuate end surfaces 96 extend between the upper and lower surfaces 90 and 92. The arcuate surfaces 96 are of a radius substantially the same as the radius of curvature of the curved surfaces 46. Three lugs 94 depend at right angles from surface 92. Mutually aligned holes 97 are formed in the lugs 94

Lobes 22 are demountably coupled to the stator 14 by inserting the lugs 94 into the holes 56 of respective lands 54. The planar surface 92 sits on the land 54 and the ramps 86 extend across adjacent ports 30 and 32 with the surfaces 88 abutting corresponding chamfered surface 60 or 68 of respective inlet port 30 or outlet port 32. An upper surface 98 of each ramp 86 is smoothly curved and extends from the intermediate surface 48 to the upper surface 90. Thus when a gate 16 wipes across the outer circumferential surface 24 there is a smooth transition between the intermediate surface 48 and lobes 22.

The lobes 22 are held in place by a mechanical locking device such as a pin that extends through a corresponding axial hole 100 (see FIG. 4) formed through the hub 42. Thus, the pin engages the lobe 22 at a location radially inside of the circumferential surface 24 and outside of the working chamber. As a result of this the pin is not exposed to or contacted by the gates 16 or the fluid in the machine 10.

Figure 8A:
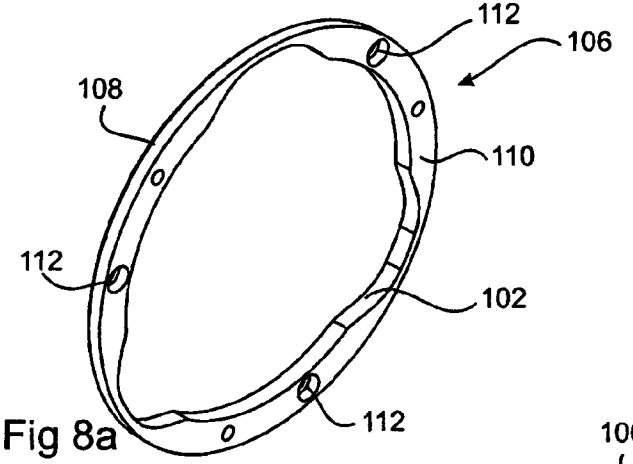
FIG. 8*a*-8*e* are views from alternate angles of a cam ring incorporated in the machine shown in FIG. 1.
Figure 8B:
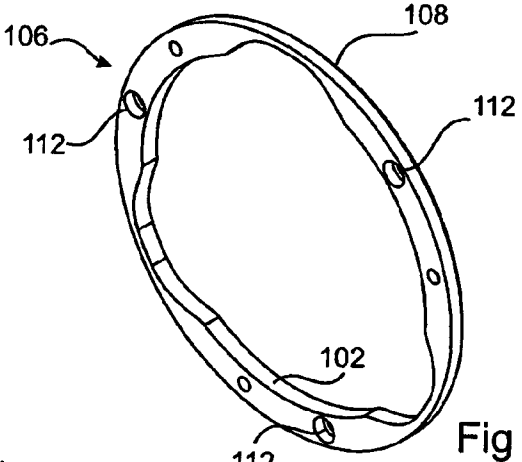
Figure 8C:
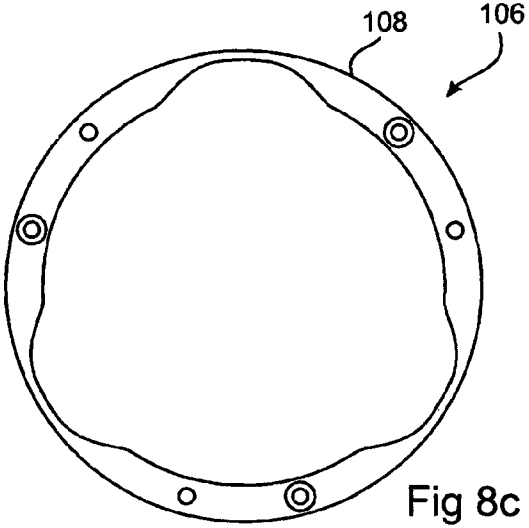
Figure 8D:
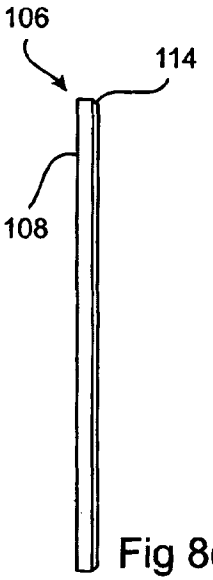
Figure 8E:
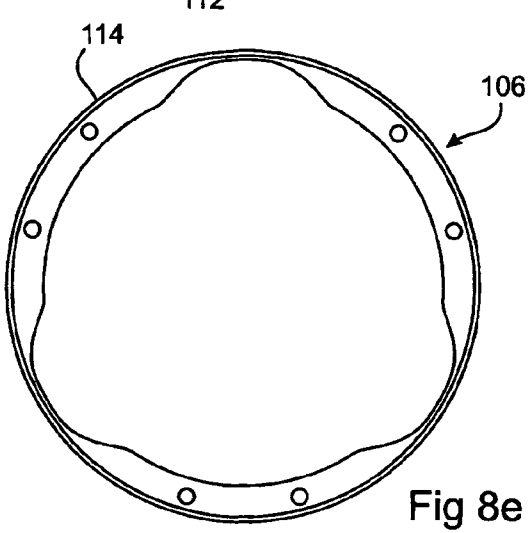

The gates 16 are operated external to the working chamber 18 by cam surfaces 102 and 104 (see FIGS. 1, 8*a*-9*c*) provided on each side of the working chamber 18 and coupled to the stator 14. In this embodiment the cam surfaces 102 and 104 on each side of the working chamber 18 are radially spaced from each other. The cam surface 102 is formed as an inner circumferential surface of a cam ring 106. The cam ring 106 is shown by itself in FIGS. 8*a*-8*e* and attached to stator 14 in FIG. 1. Each cam ring 106 has an outer circumferential surface 108 of constant diameter and a radial face 110 provided with a number of holes 112 to enable coupling of the rings 106 to the planar surfaces 52 of flanges 50. As shown in FIGS. 8*d* and 8*e*, a small bevelled edge 114 is formed about cam ring 106 adjacent outer circumferential surface 108 on a side opposite radial face 110

Figure 9B:
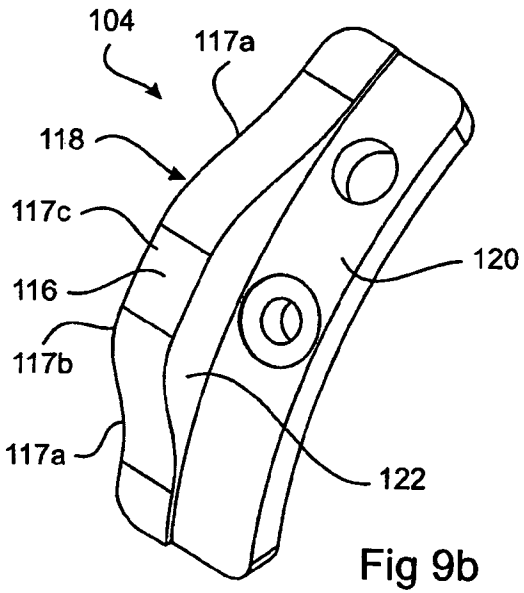
FIGS. 9*a*-9*c* are isometric views from alternate angles of a cam shoe incorporated in the machine shown in FIG. 1.
Figure 9C:
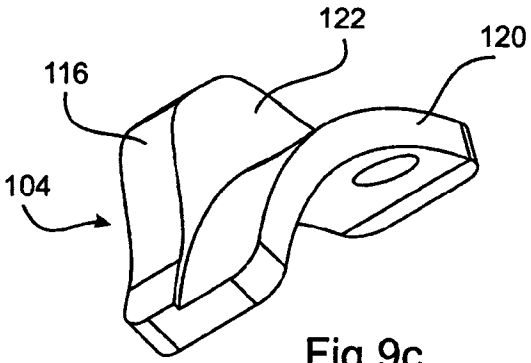
Figure 9A:
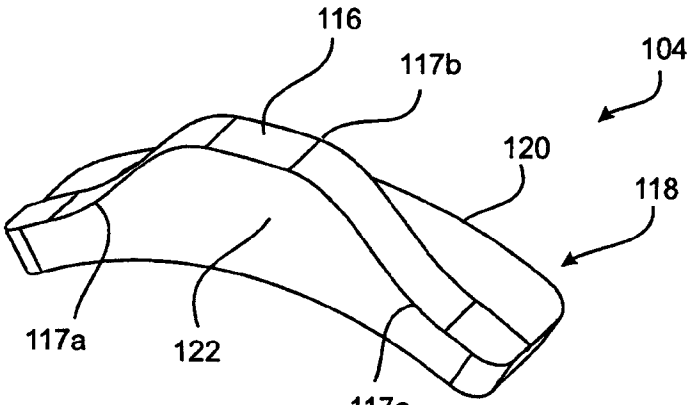

The cam surface 104 comprises the combination of: a surface 116 on each of a plurality of cam shoes 118 fixed to the stator 14; and, intervening circumferential bands 123 of the surface of the stator 14. FIG. 1 illustrates a cam shoe 118 coupled to the stator 14 while FIGS. 9*a*-9*c* illustrate the cam shoe 118 by itself. Each cam shoe 118 comprises a curved base 120 configured to seat on a corresponding land 70 formed on a stator 14, and an upstanding tongue 122. The surface 116 is the radial outermost surface of tongue 122 and comprises two outer concavely curved portions 117*a* and an intermediate convexly curved portion 117*b*. The convexly curved portion has a planar plateau 117*c*. The surfaces 116 are in axial and radial alignment with the inlet and outlet ports 30 and 32 adjacent a common lobe 22. In this instance, as there are three lobes 22 there are also three shoes 118 demountably fixed to the conduit 26 on each side of the working chamber 18. The cam surfaces 102 and 104 control the extension and retraction of gates 16 from and into their respective slots 20.

Figure 10:
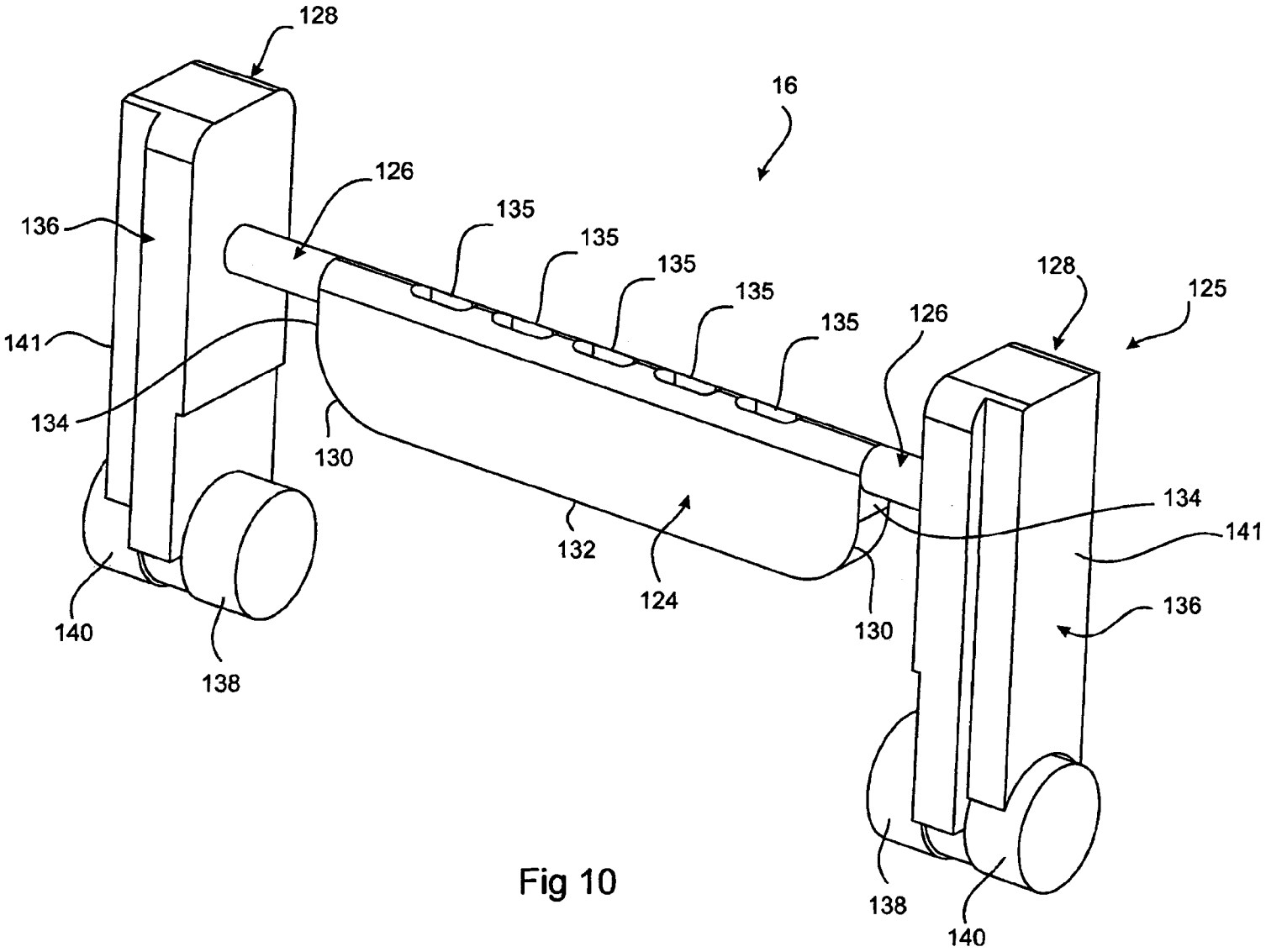
FIG. 10 is a perspective view of the gate assembly incorporated in the machine shown in FIG. 1.

FIGS. 1 and 3 illustrate the gates 16 coupled with an associated displacement mechanisms 125 in situ in machine 10, while FIG. 10 illustrates a gate 16 and an associated displacement mechanism 125 by themselves. The gate displacement mechanism is operable to reciprocate the gates 16 along a radius of the machine 10. The gate 16 comprises a wiper or blade 124 configured to run with limited clearance to the circumferential surface 24 in working chamber 18. The displacement mechanism 125 comprises pins 126 extending from each end of wiper 124, and a link 128 attached to each pin 126. As shown in FIGS. 1 and 3, the links 128 are disposed outside of and on axially opposite sides of the working chamber 18. Further each link 128 is acted upon by the cam surfaces 102 and 104 on each side of working chamber 18.

Wiper 124 has opposite curved surfaces 130 separated by an axial planar surface 132. The curved surfaces 130 extend to a planar radial surface 134 and form rounded corners of the wiper 124. The shape and configuration of the gate 16 and corresponding wiper 124 is made to match that of the outer circumferential surface 24 so that when the axial surface 132 lies substantially adjacent and parallel to intermediate surface 48 each of the curved surfaces 130 lie closely adjacent to and substantially parallel with the concavely curved surfaces 46. Stated another way the rounded corners of the gate 16 and wiper 124 nest in the curved surfaces 46. A small tolerance gap is provided between the surfaces of the gate 16 and the circumferential surface 24 to prevent face to face contact between the gates 16 and the stator 14. A plurality of radially extending channels 135 is formed in gate 16 to allow fluid flow between radially opposite sides of the wiper 124 as the gate 16 reciprocates within its respective gate slots 20. In this embodiment the channels 135 allow fluid to flow through the wiper 124. However in later described embodiments the channels 135 are formed on a face of the wiper to allow fluid to flow past or over that face.

Each link 128 comprises a leg 136 with cam followers in the form of respective rollers 138 and 140 at a radial inner end; and a radial outer face 141. In this embodiment, rollers 138 and 140 are coaxially supported but independently rotatable. In the assembled machine 10, rollers 138 are acted upon by the cam surface 102 of cam ring 106, while rollers 140 are acted upon by cam surface 104. The cam surfaces 102 and 104 cooperate to form a cam track 141 (see FIG. 1) for the rollers 138 and 140. As rotor 12 rotates relative to the stator 14, the rollers 138 and 140, and thus the displacement mechanism 125, are guided by the cam surfaces 102 and 104 to extend or retract the corresponding gates 16 from or into respective slots 20 to maintain the axial edge 132 of wiper 124/gate 16 close to the circumferential surface 24 leaving only the tolerance gap there between.

The rotor 12 comprises an assembly of components including a central or intermediate housing 142, face plates 144 disposed on either side of the intermediate housing 142, and end caps 146 disposed adjacent each of the face plates 144. These components are shown in an assembled state forming the rotor 12 in FIG. 1, and individually in FIGS. 11*a*-13*d*.

Figure 11B:
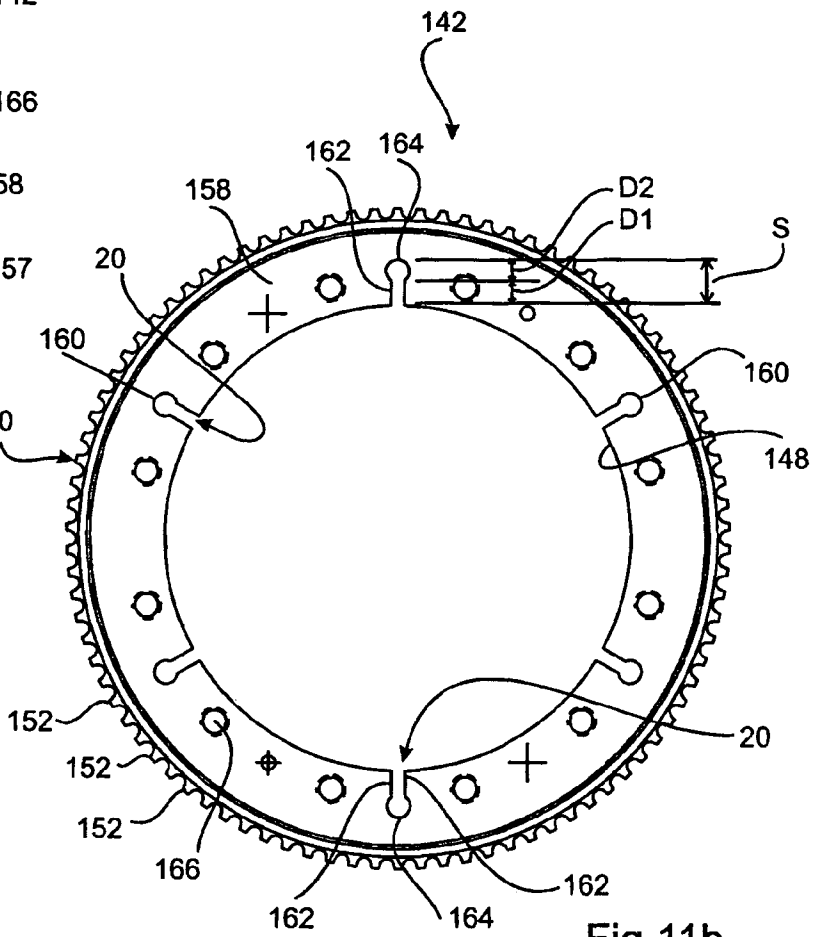
FIG. 11*b* is an elevation view of the intermediate housing shown in FIG. 11*a;*
Figure 11A:
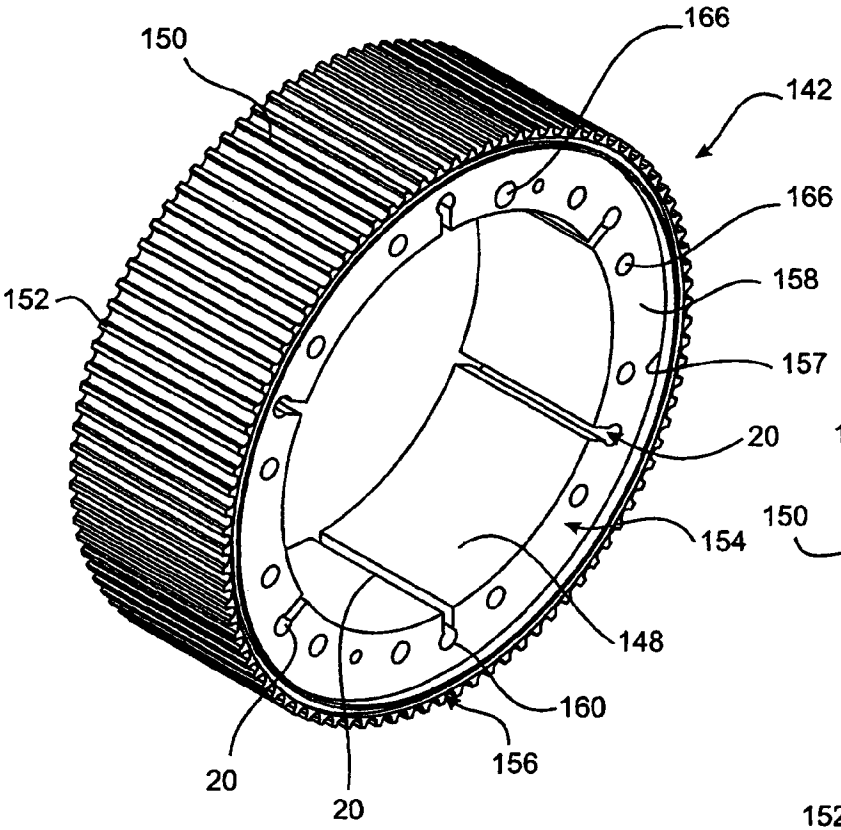
FIG. 11*a* is a perspective view of an intermediate housing incorporated in the machine.

With reference to FIGS. 1, 11*a* and 11*b* intermediate housing 142 is in the form of an annulus having a radial inner portion 154 and a contiguous radial outer band 156. The inner portion 154 of the housing has a smooth inner circumferential surface 148 of constant diameter segmented by the gate slots 20. The outer circumferential surface 150 on the outer band 156 is formed with axially extending teeth 152. In use, the teeth 152 enable coupling of the rotor 14 via for example a toothed belt to another device or machine to enable transfer of torque.

The outer band 156 over-hangs the inner radial portion 154 by equal amounts on opposite sides creating a circumferential stepped shoulder 157 on either side of housing 142. The shoulders 157 lead to planar radial faces 158 of the radial inner portion each 154.

The gate slots 20 have a depth S and are formed in the radial inner portion 154 at evenly spaced locations opening onto the inner circumferential surface 148. Each gate slot 20 also opens onto each of the radial faces 158 at opposite axial ends, but is closed at its radial outer end 160. Starting from the inner circumferential surface 148, each gate slot 20 comprises a pair of parallel spaced apart planar walls 162 which extend in a radial direction toward the teeth 152, and terminate in a contiguous arcuate portion 164 which extends between the radial outer edges of walls 162. The arcuate portion is wholly within the body of the intermediate housing 142 and thus the gate slots are blind gate slots. The provision of the arcuate portion 164 markedly reduces stress concentration in the gate slots 20 enabling the intermediate housing 142 to be made of a much smaller diameter than that with a square ended slot for the same load/pressure rating.

Figure 11C:
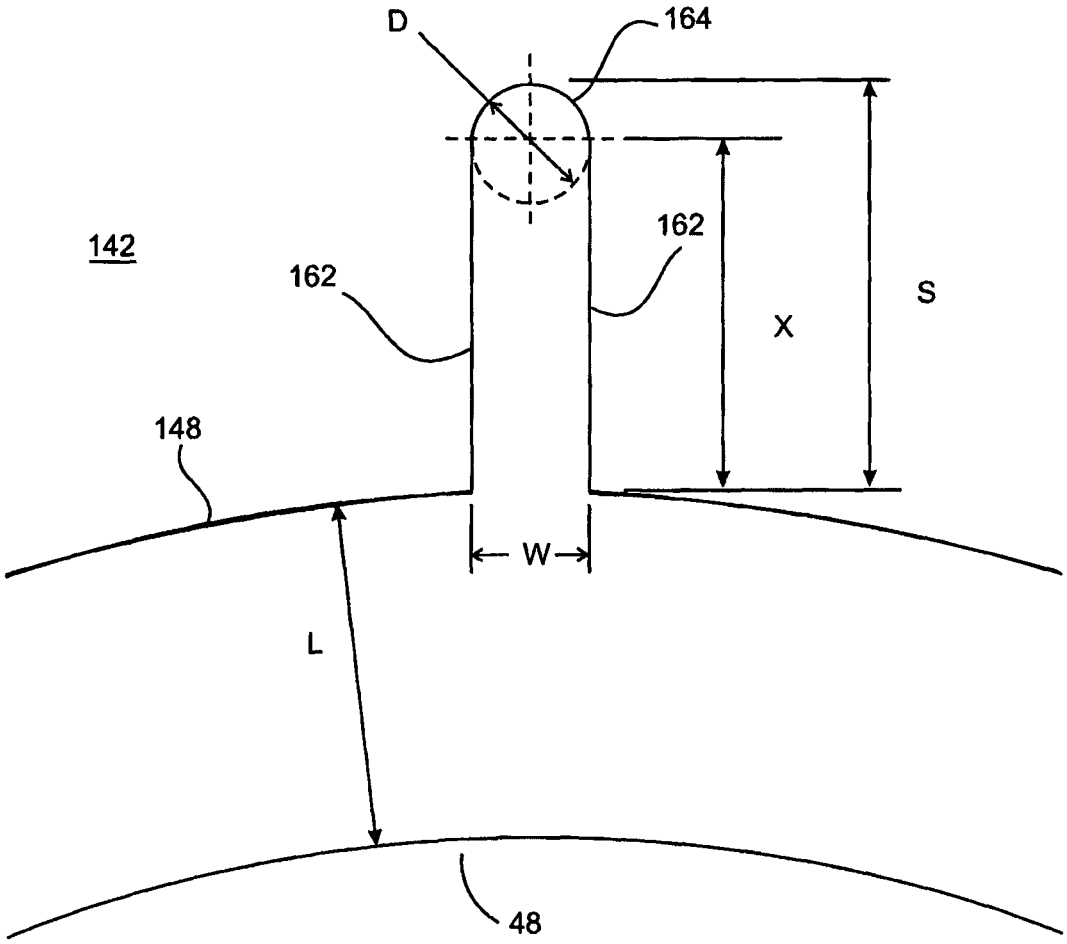
FIG. 11*c* is an enlarged view of a portion of the intermediate housing and stator showing a configuration of a gate slot.
Figure 11D:
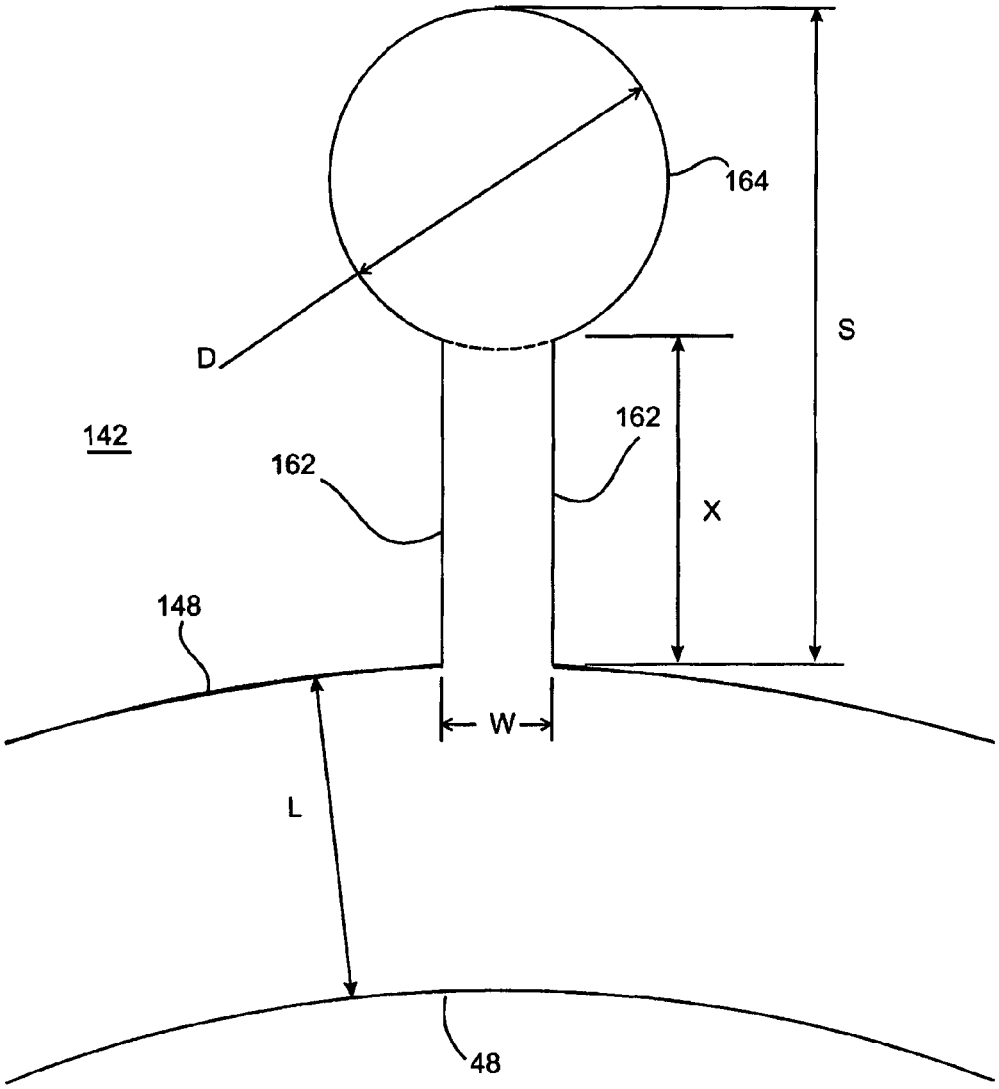
FIG. 11*d* is an enlarged view of a portion of the intermediate housing and stator showing an alternate configuration of a gate slot.
Figure 12A:
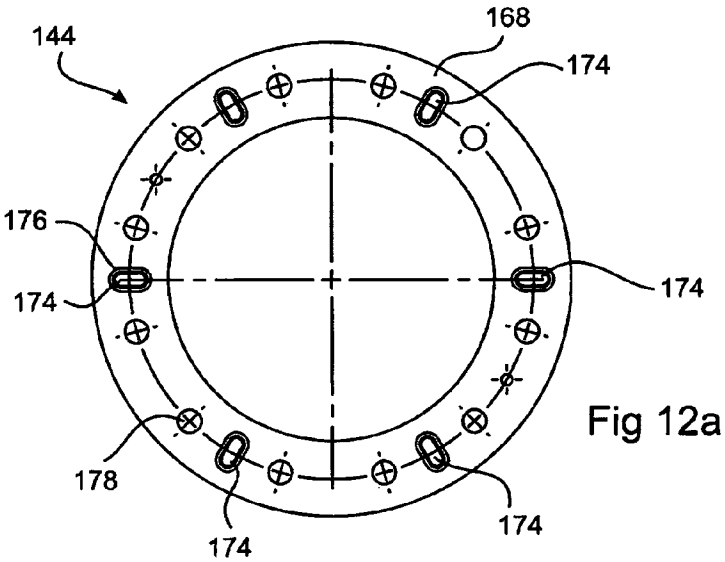
FIGS. 12*a*-12*c* provide alternate views of a face plate incorporated in the machine.
Figure 12B:
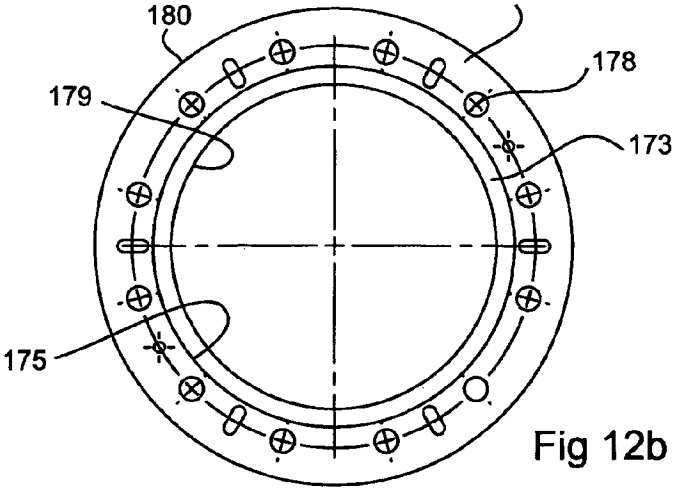
Figure 12C:
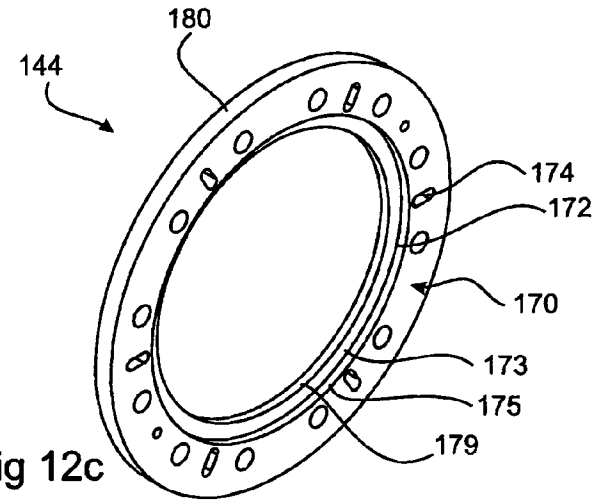

FIGS. 11*c* and 11*d* illustrate two possible gate slot configurations when the arcuate portion 164 is in the general shape of a circle. In each of these Figures:

L: is the lift of a gate 16 which is equal to the difference between the radius of surface 148 of intermediate housing 142 and the radius of surface 48 of stator 14;

W: is the transverse distance between walls 162;

X: is the radial length of a wall 162;

D: is the diameter of the arcuate portion 164; and,

S: is the total radial length, or depth of a slot 20.

In both configurations $S \approx 2L$. However it is believed that in various embodiments the slot depth may be in the range of $2L < S \leq 2.5L$. In the embodiment shown in FIG. 11*c* the diameter D of the arcuate portion 164 is the same as the slot width W. In the embodiment shown in FIG. 11*d* the diameter D is several times the width W. It is envisaged that for some embodiments of the machine 10 the relationship between diameter D and width W may vary in accordance with: $W \leq D \leq 5W$.

The diameter D is dependent on the magnitude of material strain of the rotor 12 and slot width W. The magnitude of material strain is dependent on gauge pressure and strength of material used. So generally, assuming material strain and W are constant: if gauge pressure increases then diameter D must increase; alternately if gauge pressure decreases, D is able to decrease to a minimum of W.

Consider the scenario where W is allowed to be variable and gauge pressure and material strain remain constant. The following would hold true: as W increases, D must increase; and, as W decreases, D can decrease.

Slot width W is also dependent on magnitude of material strain, therefore strength of material used and fluid pressure (i.e. the differential pressure between inlet and outlet working chambers). W is also dependent on gate lift L. So generally, when holding material strain constant: as the differential pressure increases, W must increase and/or L must decrease; and as the differential pressure decreases, W can decrease and/or L can increase.

With reference to FIGS. 1 and 12*a*-12*c*, each face plate 144 is in the form of a relatively thin annular disc provided with opposite radial faces 168 and 170; an inner circumferential surface 179 and outer circumferential surface 180. Face 170 is recessed forming an inner shoulder 172 and mutually contiguous inner radial face 173 and intermediate circumferential face 175. Six radially extending pin slots 174 formed through the face plates 144. The location of the pin slots 174 coincides with the location of gate slots 20 in the intermediate housing 142. A groove 176 is formed about each of the slots 174 on face 168 for seating respective seals (not shown). A plurality of fastener holes 178 is formed in face plate 144 at locations which register with the holes 166 in intermediate housing 142.

With reference to FIG. 1, in the assembled rotor 12, the outer circumferential surface 180 of the face plates 144 sit in the circumferential shoulders 157 on each side of intermediate housing 142; while each flange 50 of the stator 14 is received in the inner shoulder 172. This results in the surfaces 173 and 175 being in facing relationship with surfaces 52 and 53 respectively of flange 50.

Each end cap 146 shown in FIGS. 1 and 13*a*-13*d* is in the form of an annulus having an outer circumferential band 182 provided with axially extending teeth 184 of the same shape and configuration as teeth 152 on the intermediate housing 142. On an axial inner side 186 the band 182 extends beyond a radial face 188 of end cap 146. This creates a circumferential shoulder 190 between the face 188 and the band 182. Moving in a radial inward direction from face 188, there is a further stepped recess in end cap 146 creating an inner circumferential surface 191 and an adjacent radial inward directed flange 192 having a radial surface 193.

With reference to FIGS. 13*b* and 13*d*, it can be seen that on an axial outer side 194 of cap 146 there is a planar radial surface 196 which is co-planar with the axial extent of the outer circumferential band 182. Moving in a radially inward direction along surface 196, there is a stepped recess 197 forming an inner circumferential surface 198 and an outer face 200 of the flange 192.

A plurality of evenly spaced radially extending link recesses 202 is formed in the inner face 188 and partially into adjacent portion of outer band 182. The link recesses 202 register with the pin slots 174 and blind gate slots 20 in the assembled rotor 12. Each link recess 202 opens at its radial inner end on to the surface 191, and has a radial face 203. The link recesses 202 are configured to receive the links 128 of the gates 16 so that the legs 136 of links 128 can slide in a radial direction within link recesses 202. In one embodiment the legs 136 and link recesses 202 are relatively dimensioned so that the radial outer face 141 of each leg is spaced from the radial face 203 of a corresponding link recess 202.

When the rotor 12 is assembled, the end caps 146 are orientated so that their radial faces 188 are innermost and face surfaces 168 of respective adjacent face plates 144. Face plate 144 is seated in the shoulder 190 and the teeth 184 axially align with the teeth 152 in the intermediate housing 142. The surface 191 and radial adjacent face 193 of flange 192 creates a recess or space 199 (see FIG. 1) with the stator 14 within which are disposed the cam surfaces 102 and 104, and the rollers 138 and 140 of the links 128. The recess 197 of each end cap 146 seat respective bearings 210 which in turn are press fit onto opposite ends the conduit 26 of stator 14.

A sealing system is provided to substantially seal the recess 199 which contains the cam surfaces 102, 104 and the cam followers or rollers 138 and 140; from the working chamber 18. The sealing system also seals the bearing 210 from the fluid flowing through the machine. 10. Accordingly portions of the machine 10 that are in physical contact with each other when the machine is in operation (i.e. the cams and cam followers) are isolated from fluid passing through the machine 10. As the fluid may include abrasive particles and/or corrosive substances, this greatly enhances the reliability of the machine 10. It also enables machine 10 to be made with closer tolerances and operate at higher pressures.

The working chamber 18 is bound by the following surfaces: intermediate surfaces 48, opposite radial curved surfaces 46, and inner circumferential surface 148 of the intermediate housing 142. Fluid leakage paths from the chamber 18 may exist: through the slots 20 and 174; the interface between facing surfaces of flanges 50 seated in the shoulder 172 of the face plates 144, and the interface between the inner circumferential surface of the face plates 144 and the outer circumferential surface 108 of the cam rings 106.

The sealing system incorporated in machine 10 operates to prevent or minimize fluid leakage through one or more of the above mentioned leakage paths. To this end, the sealing system incorporates a number of static and dynamic seals or sealing systems. One of these is comprised of ring seals (not shown) seated in each of the grooves 176 circumscribing the pin slots 174 in face plates 144.

A first rotary seal 214 is provided between surface 52 of each flange 50 and surface 173 of an adjacent face plate 144. A further rotary seal 216 may be provided between the outer circumferential surface 53 and circumferential face 175 in recess 172 of each face plate 144. A further rotary seal 218 may be provided between the outer circumferential surface 108 of the cam ring 106 and inner circumferential surface 179 of face plate 144.

As previously described, machine 10 may operate as a motor or a pump. Further, the machine 10 is bidirectional in that it can operate with the rotor 12 rotating either clockwise or anticlockwise relative to the stator 14. This naturally however changes the direction of flow of fluid through the machine 10. When machine 10 is operated as a motor with high pressure fluid entering from inlet end 38 of conduit 26, the fluid is diverted by manifold 28 into each of the inlet ports 30. The fluid then flows into a corresponding inlet chamber 34 and acts against the gate 16 causing rotor 12 to rotate about the stator 14. As the rotor 12 rotates, the gates 16 are mechanically extended from or retracted into their slots 20 by the action of the cam surfaces 102 and 104 and the cam followers/rollers 138 and 140.

The contacting cam surfaces and cam followers within the space 199 are sealed from the working chamber 18 by action of the sealing system described above. The contact between the cam surfaces and cam followers is in substance the only mechanical contact between moving parts in the machine 10 save for the seals 214, 216 and 218, and bearings 210. In the present embodiment within the working chamber 18, the wipers 124 of the gate 16 have minimal or indeed no contact with the surface 24 and the lobes 22. Accordingly there is no or only limited wear arising in chamber 18 as a result of contact between components of the machine 10. The wear is by and large limited to that arising from the fluid passing through the machine 10. The provision of rounded corners on the gate 16 and curved surface portions of the surface 24 provides greater control over the tolerance gap between the gate 16 and surface 24 minimising fluid leakage across the gates 16. Further, the provision of the rounded corners/curved surfaces enables easier and uniform application of surface treatments to the surface of stator 14 within the working chamber 18. The provision of the arcuate portions 164 at the radial outer end of gate slots 20 reduces stress in the stator 12 enabling pump 10 to be run at higher pressures for example up to and in excess of 2000 psi.

The structure of stator 14 and rotor 12 and in particular the provision of multiple facing surfaces between the working chamber 18 and the space 199 enables the sealing system to incorporate multiple seals as described above thereby enhancing the sealing of the working chamber 18. However as will be explained in greater detail below, the sealing system may incorporate additional or alternate sealing arrangements to further enhance the sealing of chamber 18.

Forming the stator 14 with demountable (i.e. separate) lobes 22 offers numerous benefits and advantages over a stator with integrally formed lobes. For example, the surface 48 can be machined with a uniform outer diameter with the flat lands 54 being milled or otherwise formed subsequently. Thereafter the lobes 22 can be easily mounted onto the lands 54. This is to be contrasted with the difficulty in machining a circumferential stator surface with one or more integral lobes which will require relative displacement between the centre of the stator 14 and a cutting tool while the stator 14 is being machined. Providing the lobes 22 as separate demountable components also improves reliability and eases maintenance. Further the option becomes available to improve compatibility in the materials from which the stator 14 and the lobes 22 are made and the fluid passing through the machine 10.

Figure 14:
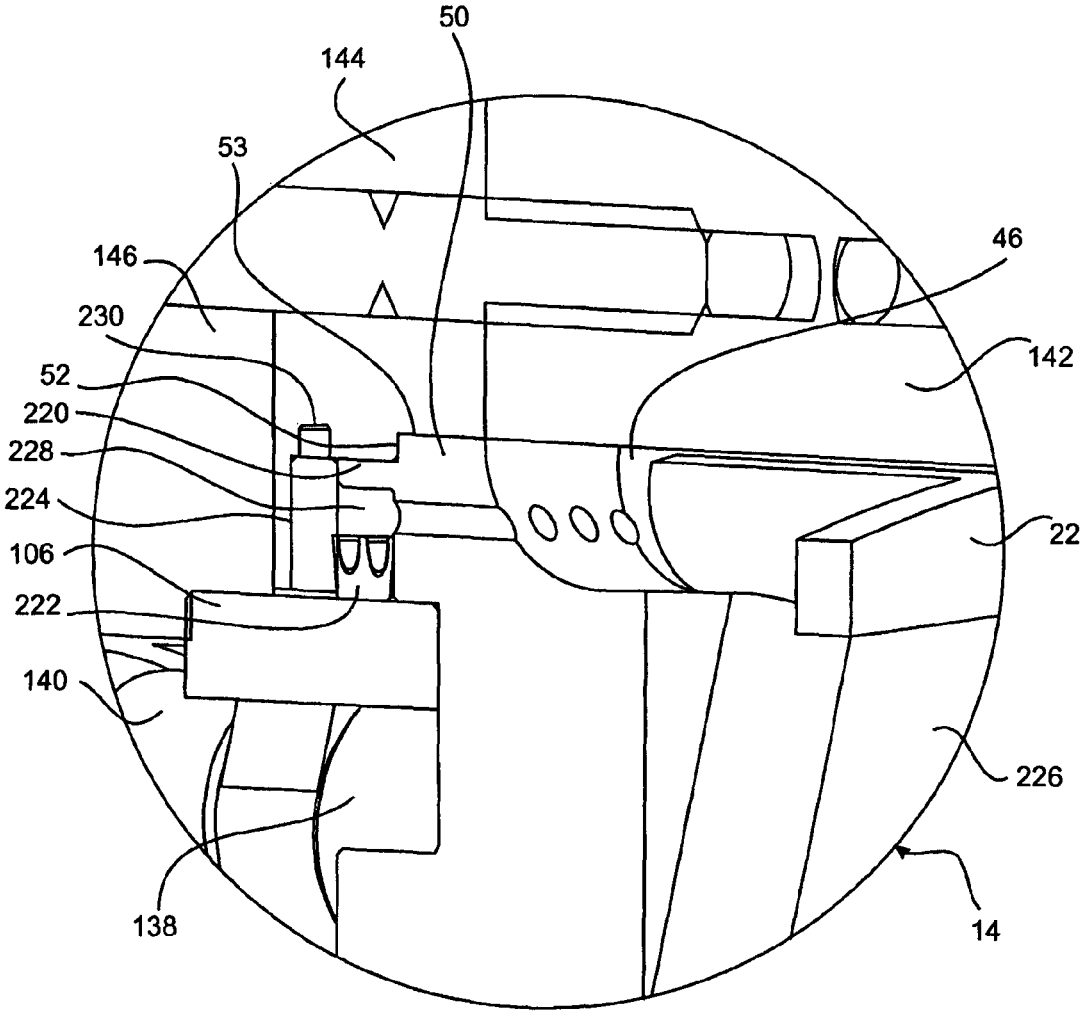
FIG. 14 is a schematic representation of a sealing and pressure equalisation arrangement that may be incorporated in an embodiment of the machine.

FIG. 14 illustrates an example of an alternate sealing arrangement. In this embodiment, the stator 14 is provided with a circumferential lip 220 protruding in an axial direction from face 52 of each flange 50. The lip 220 is disposed a short distance radially inside of the face 53 of flange 50. Disposed between the lip 220 and cam ring 106 is a double chevron seal 222. The seal 222 sits on outer circumferential surface of cam ring 106. An annular Teflon disc or washer 224 also sits on the cam ring 106 and adjacent both the seal 222 and the lip 220. The washer 224 is retained in place by the face plate 144. A dynamic O-ring seal 230 is seated in a groove formed in face plate 144 and seals against an outer circumferential surface of the washer 224.

A number of axially extending pressure relief ports 226 are formed in the flange 50 through the radial curved surface 46 into a space 228 between the seal 222 and lip 220. The ports 226 are in fluid communication with the low pressure chamber(s) of the machine. In a motor application this would be the outlet chamber 36. In a pump application the ports would communicate to the inlet chamber 34 adjacent to the inlet port 30. This relieves high pressure from the seal 222 which can slowly leak through the ports 226.

Figure 15:
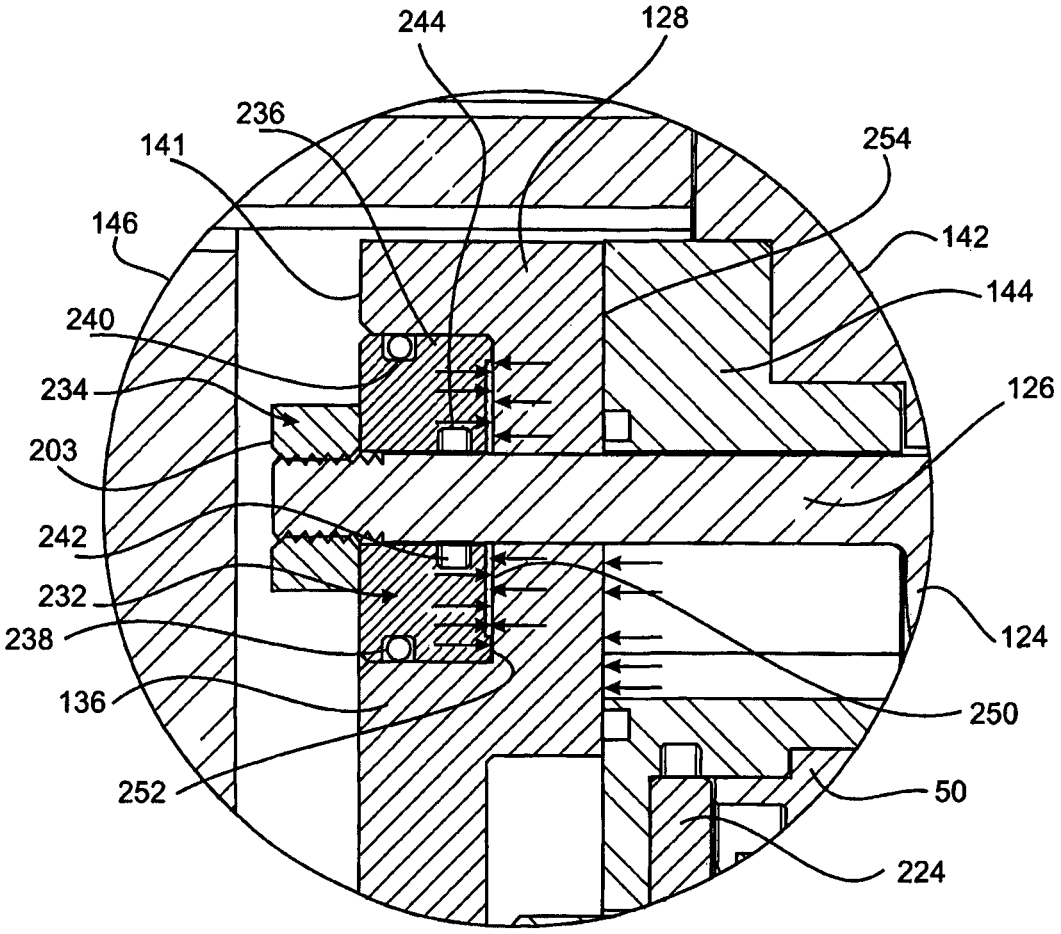
FIG. 15 is a schematic representation of a possible arrangement for construction of a portion of a gate displacement mechanism incorporated in the machine.
Figure 16:
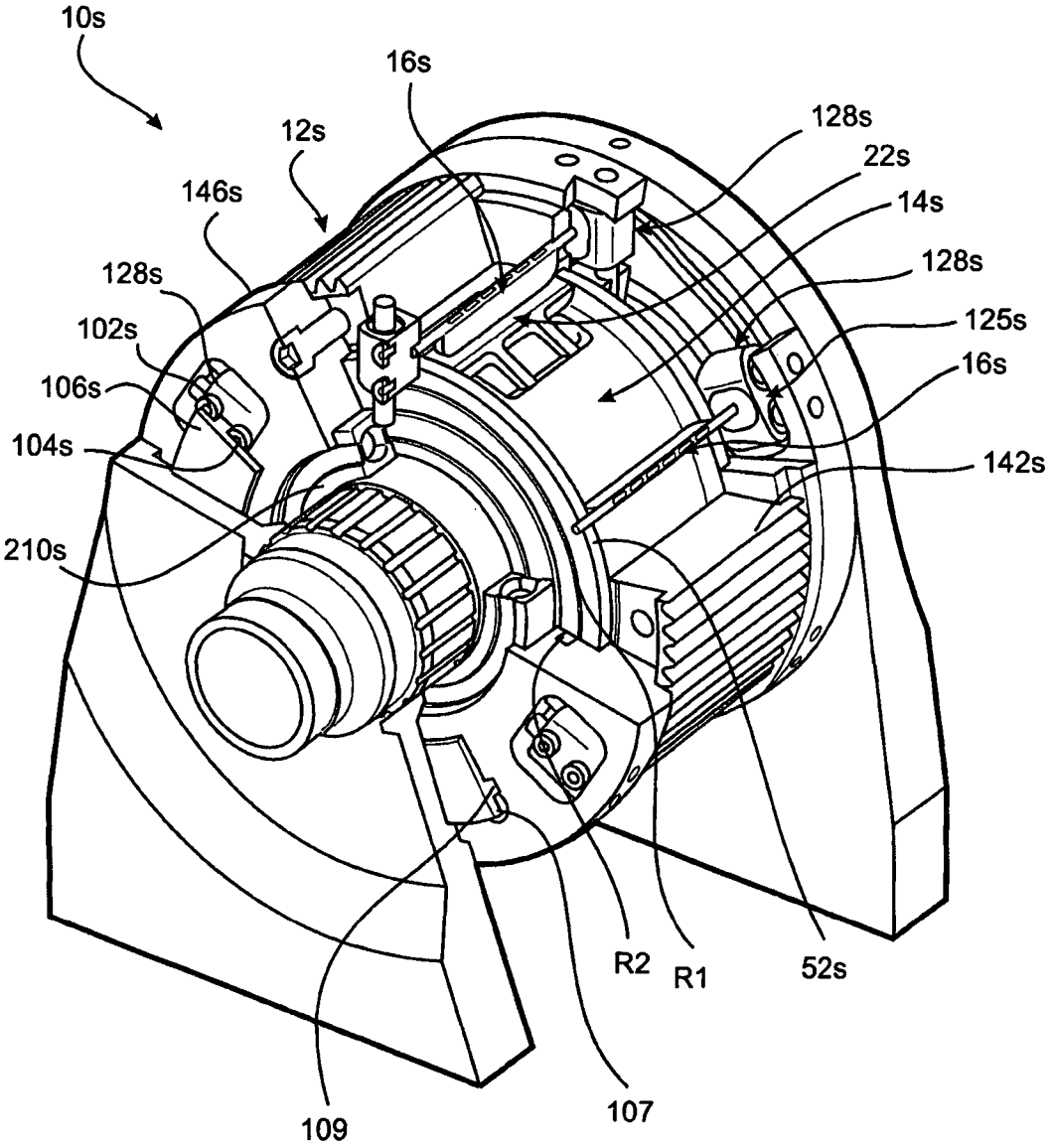
FIG. 16 is a cut away schematic representation of a second embodiment of a machine in accordance with the present invention.

FIG. 15 illustrates a further embodiment of, or variation to, machine 10 with the aim of maintaining a near zero gap between the legs 136 of the links 128 and the face 168 of the face plate 144. This maintains the sealing area between these components. In this embodiment pins 126 of the gates 16 are retained on corresponding legs 136 of the links 128 by a piston 232 and a nut 234. Piston 232 is seated within a recess 236 formed in the leg 136. A circumferential seal 238 is provided in a groove 240 formed about the outer circumferential surface of piston 232. A further O-ring seal 242 is seated in an inner circumferential groove 244 in piston 232 and surrounds the pin 126. Nut 234 retains the piston 232 on the pin 126. The nut sits in the radial slot 203 of intermediate housing 146 which accommodates the corresponding leg 136.

A shallow recess 250 is formed on a face 252 of piston 232 facing the leg 136 in the axial direction. In this arrangement, fluid pressure is communicated to the recess 250 between the pins 126 and the holes in the legs 136 through which the pins 126 extend. This pressure is the same as the pressure acting in the working chamber 18 and upon the axially inner most surface 254 of leg 136. Also the surface area of the leg on which the pressure from the piston side acts is the same as the surface area on the surface 254 of the same leg 254 on which the pressure from the adjacent working chamber acts. This provides hydraulic balancing across the links 126 to maintain the near zero gap between legs 136 and face 168 of the face plates 144.

In an alternative embodiment the back 141 of each leg 136 can be supported on the face of the end caps 146 inside of slots 203. A piston similar to piston 232 is still required but the gate legs 126 would not extend beyond the back 141 of the legs 136. Instead it too would be supported by the back of the end cap on face 203. This would eliminate the need for seal 242.

FIGS. 16-24*b* depict a second embodiment of the machine. This embodiment is denoted by the reference number 10*s*. In describing the machine 10*s* identical reference numbers are used to denote identical features or similar to the machine 10 shown in FIGS. 1-15 but with addition of the suffix "s".

The machine 10*s* has the same basic working components as the machine 10 and operates in the same manner. In this regard machine 10*s* comprises a rotor 12*s*, stator 14*s* with a central conduit 26*s*. A working chamber 18*s* is defined between the rotor 12*s* and stator 14*s*. Fluid flow through the machine 10*s* is identical to that in the machine 10. The substantive differences between the machines 10 and 10*s* reside in the structure and/or configuration of the stator 14*s*, displacement mechanism 125*s*, cam ring 106*s*, gates 16*s*, lobes 22*s*, rotor 12*s* and sealing arrangement between the stator 14*s* and the rotor 12*s*.

FIGS. 16-19*b* show in particular the modified configuration of the displacement mechanism 125*s*, cam rings 106*s*, and associated components of the rotor 12*s*. In the machine 10*s*, the rotor 12*s* comprises a central or intermediate housing 142*s* identical to the housing 142; but in place of the individual face plates 144 and end caps 146, the housing 10*s* comprises integrated end caps 146*s* on each side of the intermediate housing 142*s*. Each of the integrated end caps 146*s* houses a plurality of displacement mechanisms 125*s*.

In general terms, the integrated end cap 146*s* may be considered to be a combination of an end cap 146 and the face plate 144. End cap 146*s* is in the form of an annulus having: a central opening 280 through which opposite sides of the conduit 26*s* pass; and, opposite radial surfaces 168*s* and 196*s*. The surfaces 168*s* are directed toward the intermediate housing 142*s* of the rotor 12*s* while the radial surfaces 196*s* face away from the intermediate housing 124*s*. An outer circumferential shoulder 281 (see FIGS. 17*a* and 18*b*) is formed about an outer radius of the surface 168*s*, and an inner circumferential shoulder 282 is formed about an inner radius of the surface 168*s*. In the assembled rotor 12*s*, the shoulder 281 engages the shoulder 157*s* in the intermediate housing 142*s* and the surface 168*s* abuts the radial face 158*s*.

The ball bearings 210*s* are shown seated in the end caps 146*s*. O-rings 147 (shown in FIGS. 17*a* and 19*a*) are held in annular grooves formed in the opposite faces 52*s* of the stator 14*s*. The O-rings 147 bear against and provide a small bias to the bearings 210*s*. This assists in maintaining a tight fit of the bearings 210*s* between stator 14*s* and the rotating integrated end caps 146*s*.

O-rings 277 form a seal between the end caps 146*s* and respective adjacent faces of the intermediate housing 142*s*. Each O-ring 277 is formed with a plurality of radial hoop extensions 297. The extensions 279 extend about the ends of respective slots 20*s* in the end caps 146*s*. The surfaces 168*s* are provided with shallow grooves (not shown) to seat the O-rings 277.

Figure 18A:
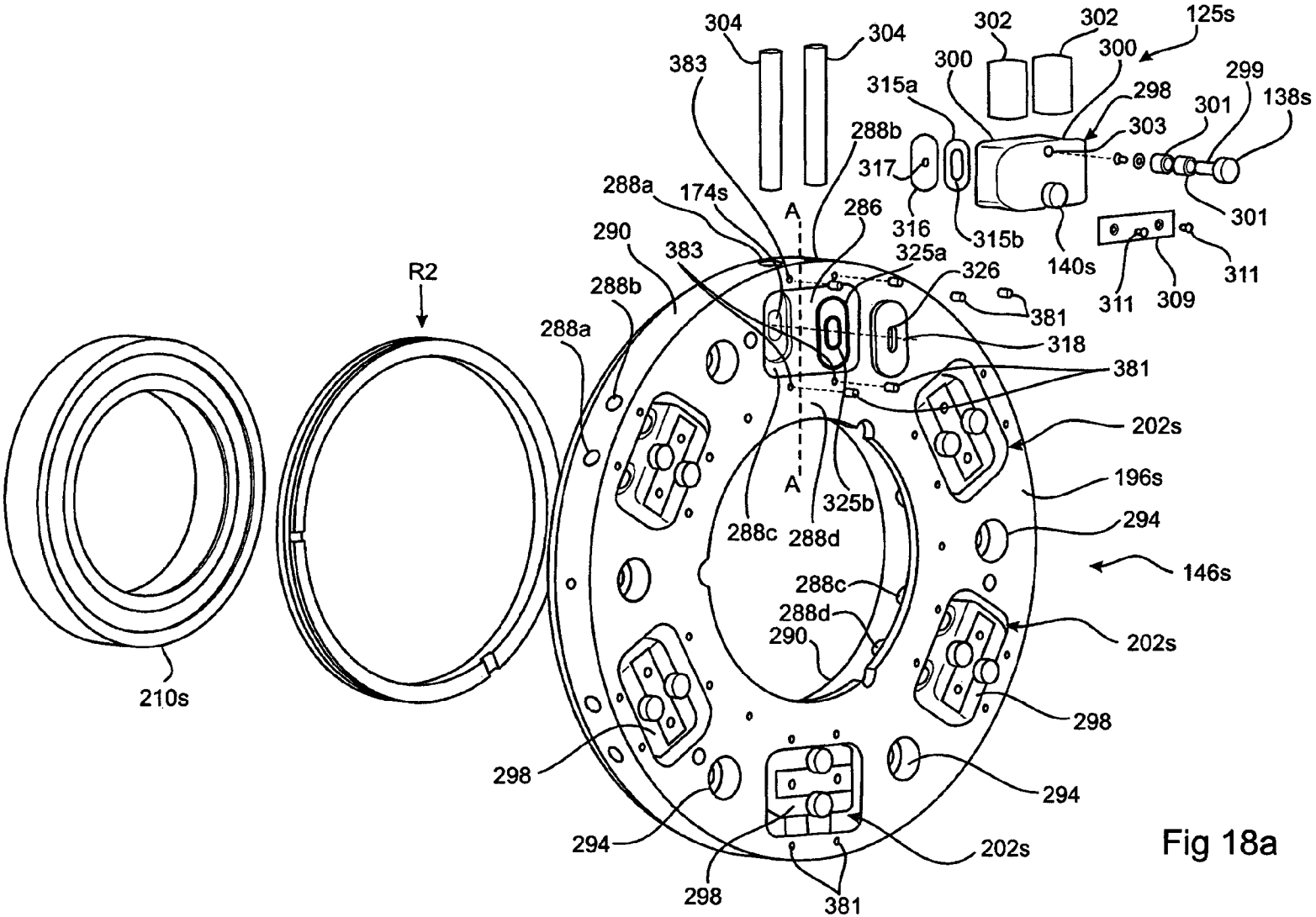
FIG. 18*a* is a partially exploded view of an integrated end cap incorporated in the second embodiment of the machine shown in FIG. 16.
Figure 18B:
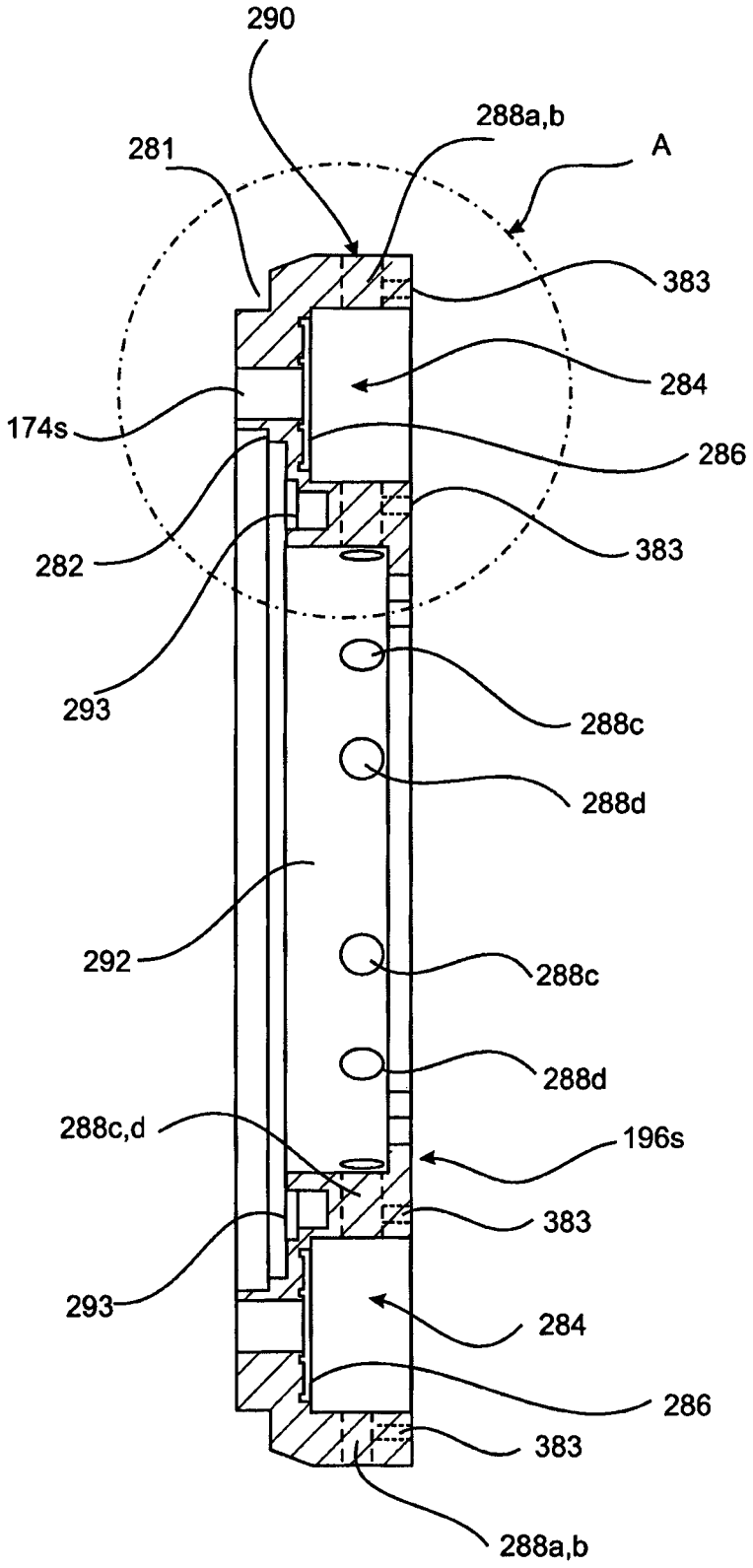
FIG. 18*b* is a view of a section through a diameter of the integrated end cap shown in FIG. 18*a;*

With particular reference to FIGS. 18*a* and 18*b* a number of substantially rectangular and evenly spaced apart link recesses 202*s* are formed in the radial face 196*s* of integrated end cap 146*s*. Each link recess 202*s* terminates in a planar back wall 286. Respective slots 174*s* open onto the wall 286 of each link recess 202*s*, and onto the radial surface 168*s*. The slots 174*s* correspond with the slots 174 in the machine 10. Four holes 288*a*, 288*b*, 288*c* and 288*d* (hereinafter referred to in general as "holes 288") are formed in the integrated end cap 146*s* in each link recess 202*s*. The holes 288*a* and 288*b* extend in a generally radial direction from an outer circumferential surface 290 of the integrated end plate 146*s* opening into a radially outer face of the link recess 202*s*. The two holes 288*c* and 288*d* also extend in a generally radial direction and extend between a radially inner face of the link recess 202*s* and an inner circumferential surface 292 of the integrated end plate 146*s* The surface 292 forms a seat for the ball bearing 210*s*. Each link recess 202*s* is located between or inboard of the outer and inner circumferential surface 290, 292.

An annular groove 293 is formed radially outward of the surface 292 on the same side of the integrated end cap 146*s*. The holes 288*a* and 288*c* have a common axis as do holes 288*b* and 288*d*. The axes of these respective pairs of holes are parallel to each other. A number of axially extending through holes 294 are provided in the integrated end plate 146*s* for receiving bolts 296 (see FIG. 17*a*) used to attach the integrated end caps 146*s* onto opposite sides of the intermediate housing 142*s*.

The links 128*s* of the displacement mechanisms 125*s* comprise substantially rectangular blocks 298 which are functionally similar to the legs 136 of the machine 10. Rollers 138*s* and 140*s* are rotatably mounted on each block 298 on respective axles 299. The rollers 138*s* and 140*s* are on the same side of the block 298 and are radially aligned with each other. A pair of parallel spaced apart holes 300 is formed in each block 298 and extends in a generally radial direction. The holes 300 seat respective cylindrical bearings 302. Each block 298 is mounted in a respective link recess 202*s* by a pair of parallel guides or rails 304. One of the rails 304 passes through hole 288*a*, an aligned bearing 302 and hole 288*c*, while the other passes through the hole 288*b*, an aligned bearing 302 of the same block 298 and hole 288*d*. The blocks 298 are dimensioned to be smaller in the radial direction than the link recesses 202*s* to enable the links 128*s* to reciprocate in a generally radial direction along the rails 304. The rails 304 are held in place by grub screws 381 which screw into holes 383 formed the radial surface 196*s* of integrated end cap 146*s*.

Figure 19B:
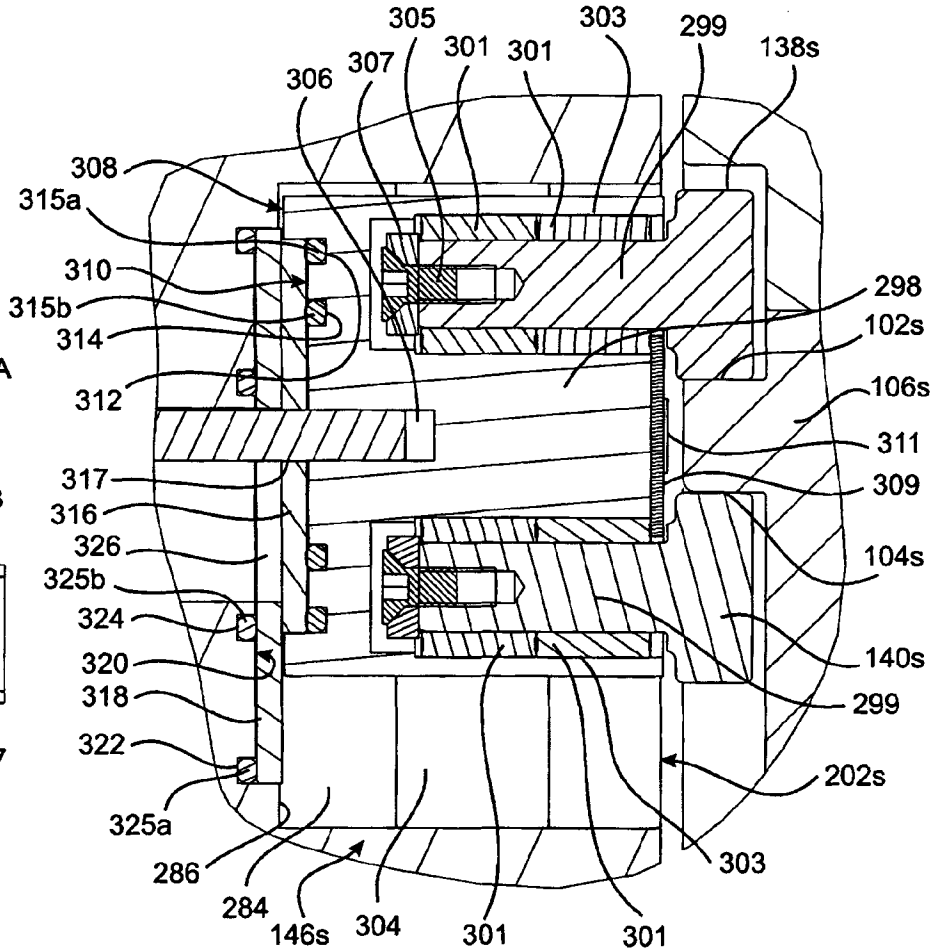
FIG. 19*b* is a view of detail A of FIG. 19*a;*
Figure 19A:
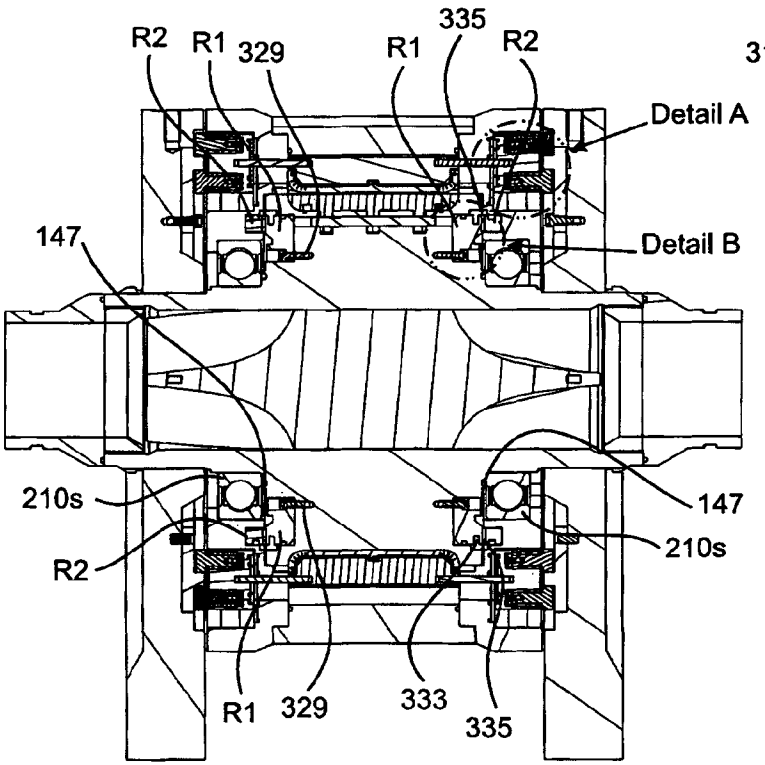
FIG. 19*a* is a section view of the second embodiment of the machine.

With particular reference to FIGS. 18*a* and 19*b*, the rollers 138*s* and 140*s* are formed with integral axles 299. The axles 299 are received in each of two aligned bearings 301 which in turn are seated in respective holes 303 in the block 298. A screw 305 and washer 307 engage each axle 299 to retain them within bearings 301. A plate 309 is attached by screws 311 on a front face of the blocks 294 to hold the bearings 301 in the blocks 298.

Still referring to FIGS. 18*a* and 19*b* a blind hole 306 is formed in an axial direction into a back face 308 of block 298. The hole 306 is configured to receive the pin 126*s* at one end of a respective wiper 124*s*. The back face 308 is also formed with a shallow wide recess 310.

Penetrating further into the back face 308 from the recess 310 are two endless grooves 312 and 314 each in the general configuration of an ellipse. The grooves 312 and 314 seat respective O-rings 315*a*, 315*b*. A relatively thin seal plate 316 sits in the recess 310 against the O-rings 315*a*, 315*b* and is provided with a hole 317 through which the pin 126*s* extends. The hole 317 is in alignment with the hole 306.

A further seal plate 318 is seated in a shallow recess 320 formed in the back wall 286 of link recess 202*s*. A pair of endless grooves 322 and 324 penetrates from the recess 320 further into the back wall 286. O-rings 325*a* and 325*b* are seated in grooves 322 and 324, respectively. The seal plate 318 is formed with a longitudinal slot 326 which is in registration with (i.e. coincide in location and configuration with) a respective pin slot 174*s*. As the link 128*s* reciprocates, the seal plate 316 moves with the block 298 while the seal plate 318 is stationary relative to the integrated end cap 146*s*. Facing surfaces of the seal plates 316 and 318 are highly polished to the extent of forming a substantial fluid seal there between. This provides a mechanical fluid seal preventing working fluid from leaking from the working chamber through the recesses 202*s*.

Reciprocation of the links 128*s* and thus the displacement mechanism 125*s* is caused by the rotation of the rotor 12*s* and the cooperation of the rollers 138*s* and 140*s* with the respective cam rings 106*s*. Each cam ring 106*s* replaces the cam surfaces 102 and 104 on each side of the stator 14 in the machine 10. Thus, instead of requiring one cam ring 106 and three cam shoes 118 on each side of the stator 14 as per machine 10, in machine 10*s*, a single cam ring 106*s* is used to provide both cam surfaces 102*s* and 104*s* (see FIGS. 16 and 19*b*). The cam ring 106*s* is in the form of a planar annular disc 107 with ad axially extending continuous cam rail 109.

In place of the seals 214, 216 and 218 shown in FIG. 1 and the alternate sealing system shown in FIG. 14; the embodiment of FIGS. 16-24*b* has a sealing system which comprises mechanical fluid seals. Respective mechanical seals are provided between each end cap 146*s* and the respective adjacent face 52*s* of the stator 14*s*. With particular reference to FIGS. 16, 17*b*, 18*a*, 19*a* and 19*c* each mechanical seal comprises a stator sealing ring R1 and an end cap sealing ring R2.

Figure 17A:
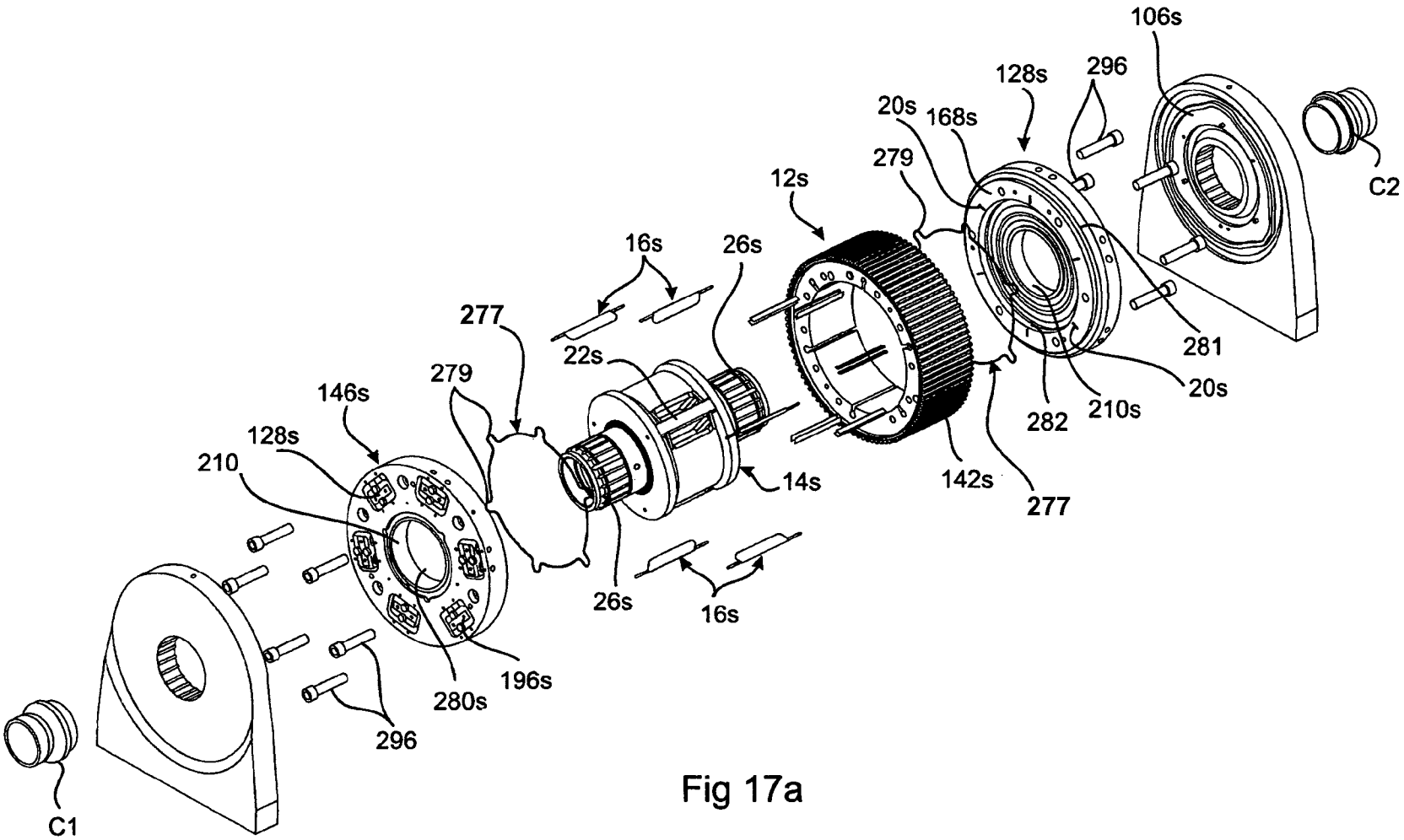
FIG. 17*a* is an exploded view of the machine shown in FIG. 16.
Figure 17B:
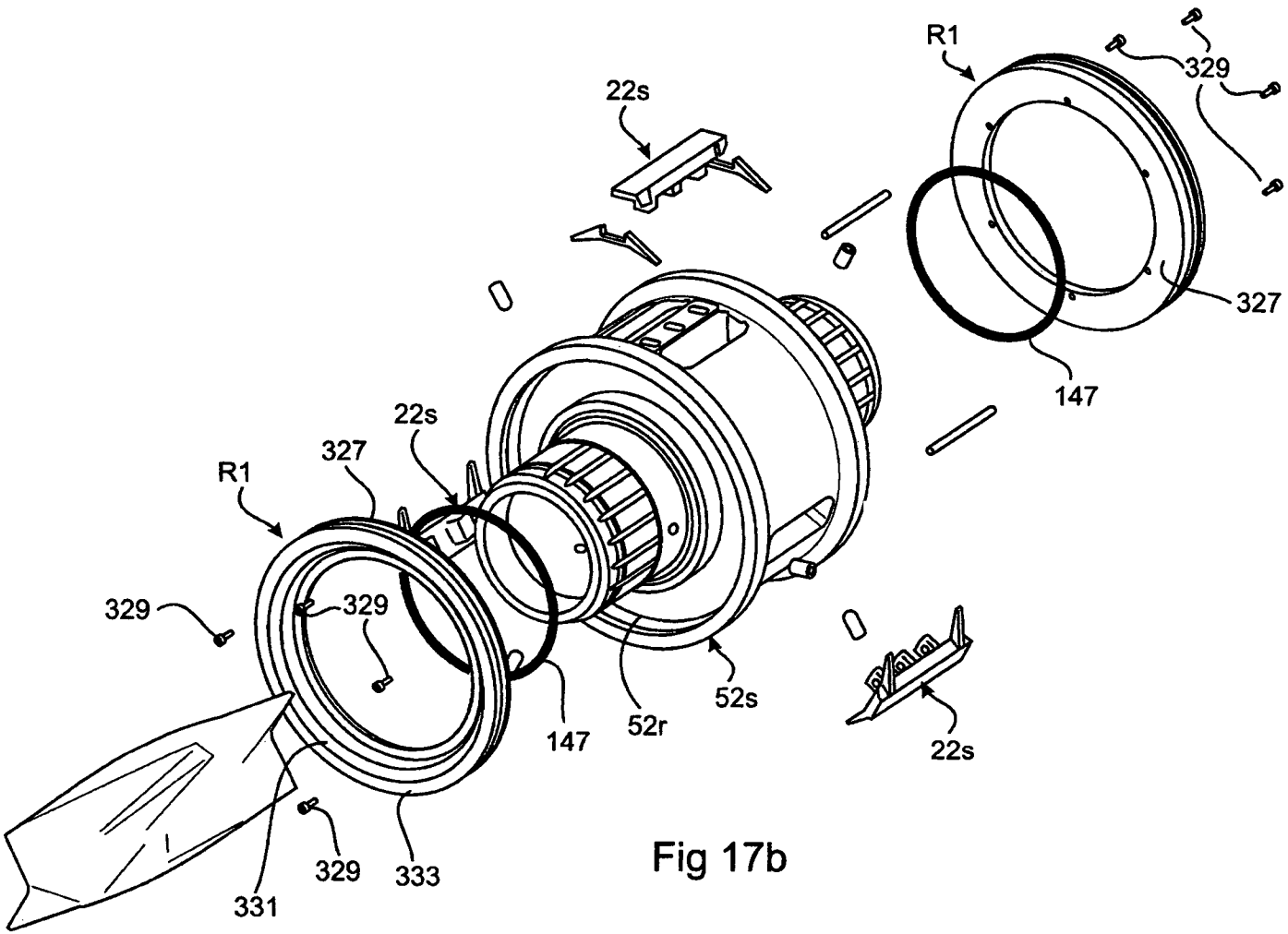
FIG. 17*b* is a further exploded view of the machine shown in FIG. 16 but showing the stator and some associated components in greater detail.
Figure 19C:
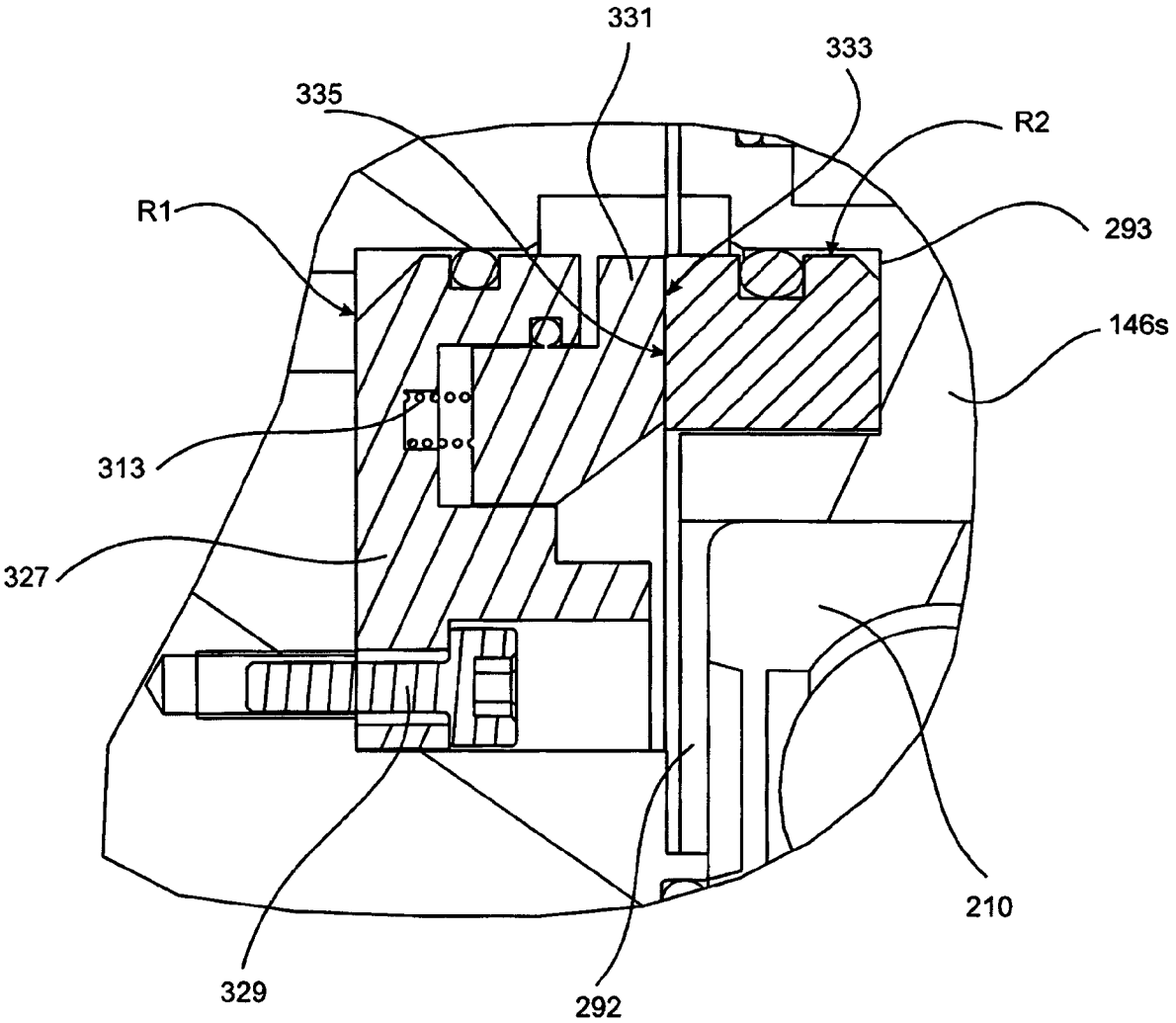
FIG. 19*c* is a view of detail B of FIG. 19*a;*
Figures 20A, 20B, 20C, 20D, 20E:
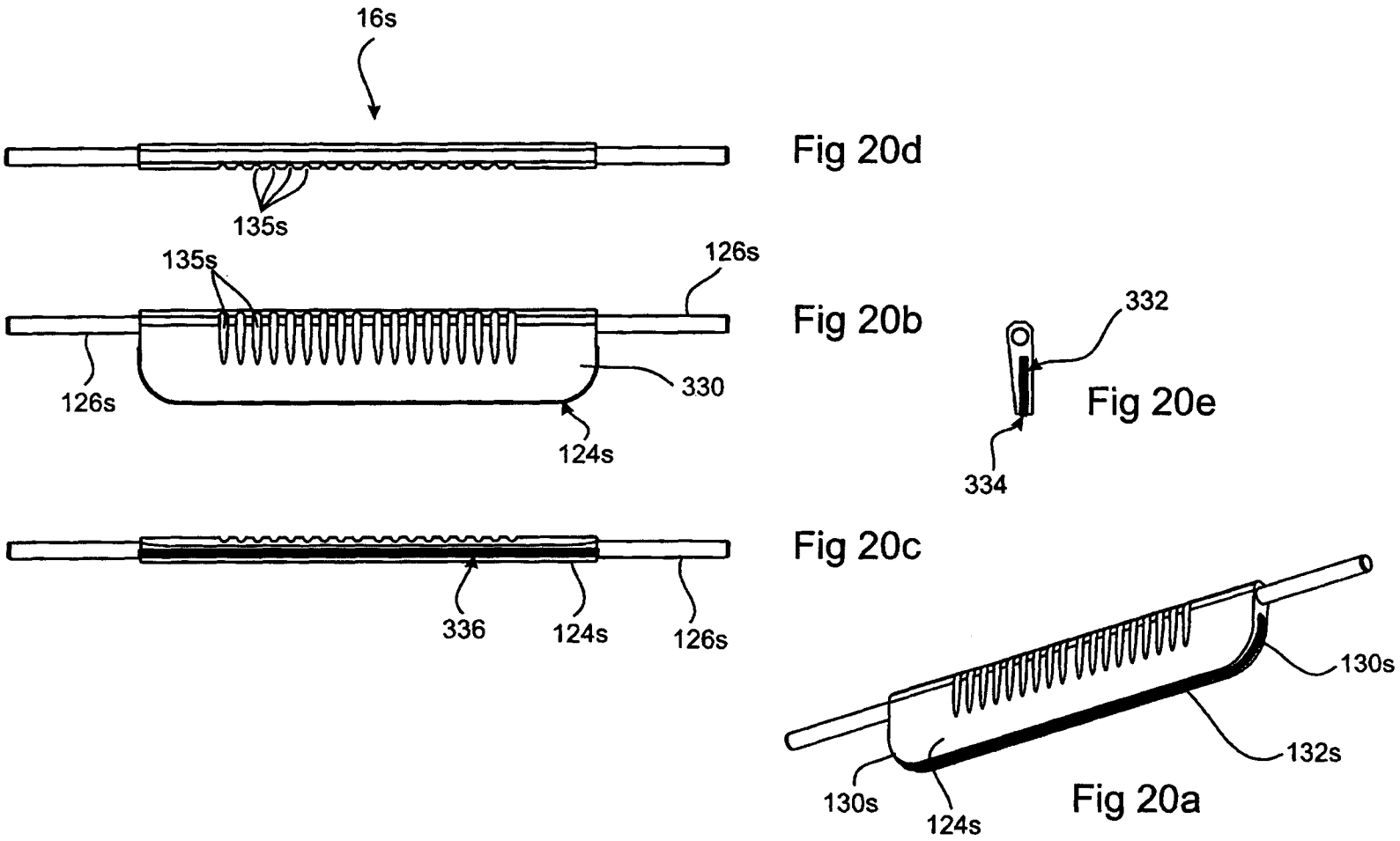
FIG. 20*a* is an isometric view of a gate incorporated in the machine shown in FIG. 16.
FIG. 20*b* is a side elevation view of the gate shown in FIG. 20*a;*
FIG. 20*c* is a bottom elevation of the gate shown in FIG. 20*a;*
FIG. 20*d* is a top elevation of the gate shown in FIG. 20*a;*
FIG. 20*e* is a side elevation of the gate shown in FIG. 20*a;*
Figure 21A:
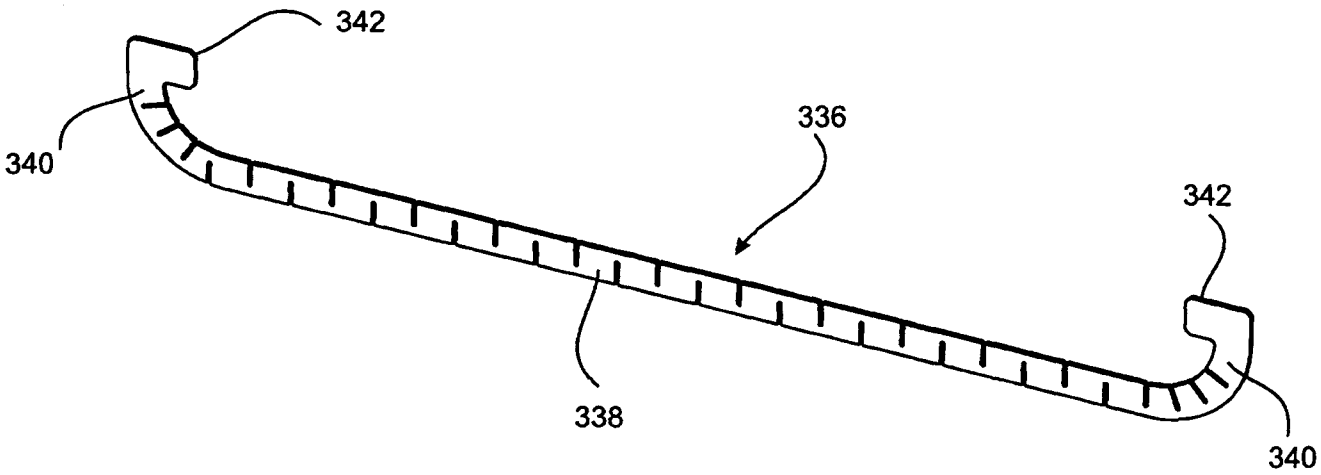
FIG. 21*a* is an isometric view of a sealing strip incorporated in the machine shown in FIG. 16.
Figure 21B:
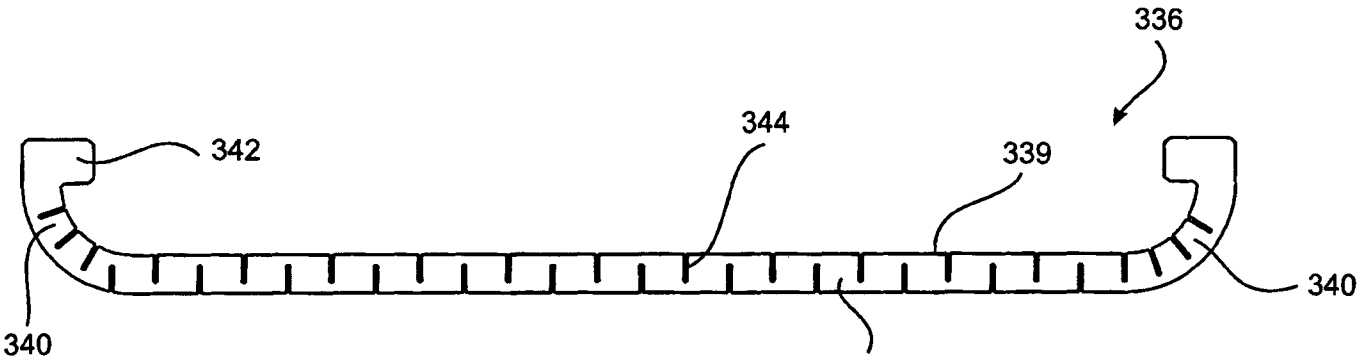
FIG. 21*b* is a front elevation of the sealing strip shown in FIG. 21*a;*

The ring R1 is in the form of a metal ring body 327 which is held by bolts 329 in a circumferential recess 52*r* formed on face 52*s* (FIGS. 17*b* and 19*c*). An annulus 331 made from a wear resistant material such as tungsten carbide having a polished axial face 333 is held in the ring body 327. The annulus 331 is biased toward the sealing ring R2 by a spring 313.

The ring R2 is held in the groove 293 in the integrated end cap 146*s* and has a polished face 335 that is arranged to contact the face 333. The polished face 333 may be made from or at least coated with the same wear resistant material as that used for the annulus 331. The two polished faces 333 and 335 are biased into contact by the spring 313 and form a seal against each other preventing the passage of fluid there between.

FIGS. 20*a*-22*b* depict the modified gate 16*s* of the machine 10*s*. Each gate 16*s* performs the same function as the gate 16 in the machine 10. In particular each gate 16*s* is provided with a central wiper or blade 124*s*. The pins 126*s* are formed separately from the wiper 124*s* and inserted into holes on opposite sides of the wiper 124*s*. Opposite ends of the pins 126*s* are seated in respective links 128*s*. Each wiper 124*s* is provided with a series of radially extending channels 135*s* on one side surface 330. The channels 135*s* perform a similar function to the channels 135 in the wipers 124.

A recess 332 is formed in the wiper 124*s* which opens onto axial planar surface 132*s* and adjacent opposed curved surfaces 130*s* of the wiper 124*s*. The recess 332 seats a gate seal system 334. The gate seal system 334 comprises in combination one or more flexible planar sealing bands 336 and a biasing element 337 which may be in the form of an O-ring or metal spring. The gate seal system 334 forms a dynamic seal against the circumferential surface 24*s*.

The or each band 336 comprises a straight length 338 and respective integrally formed curved portions 340 at each end. Each curved portion 340 terminates in an inwardly directed peg 342. The overall radial outer most shape and configuration of the sealing band 336 is substantially the same as the shape and configuration of the surfaces 130*s* and 132*s* of the wiper 124*s*.

The flexibility of the sealing bands may be provided by way of the material used to make the bands. That is, by using a flexible material the bands will have inherent flexibility. Alternately or additionally flexibility can be provided by forming a plurality of transverse slots 344 in the band 336. The slots 334 formed in the curved portions 340 facilitate flexing of the curved portions in a plane containing a corresponding sealing band. The slots 344 on mutually adjacent sealing band 336 are laterally offset from each other. As a consequence when two or more bands 336 are placed adjacent each other there is no direct fluid flow path across the gate seal system 334 through the slots 344.

Two or more of the sealing bands 336 are retained in the recesses 332 by engagement of the pegs 342 in complementary rebates formed inside of the recess 332. The bias mechanism 337 is likewise seated in a complementary groove or recess formed within the recess 332 and positioned to apply a bias on the sealing bands 336 so that they extend beyond the surfaces 130*s* and 132*s* of the wiper 124*s*. Further, the sealing bands 336 are retained in the wiper 124*s* in a manner to allow axial motion as well as radial motion. In one example, the sealing bands 336 may be made from a metal or alloy such as bronze. The ability of the sealing bands 336 to move axially and radially enables them to maintain contact with surfaces of the stator 14*s* while allowing for a small degree of relative axial motion between the rotor 12*s* and the stator 14*s* arising from engineering tolerance in the manufacture of the machine 10*s*. Put another way the sealing system 332 enables the manufacture of the machine 10*s* with less demanding tolerance than machine 10.

Figure 22A:
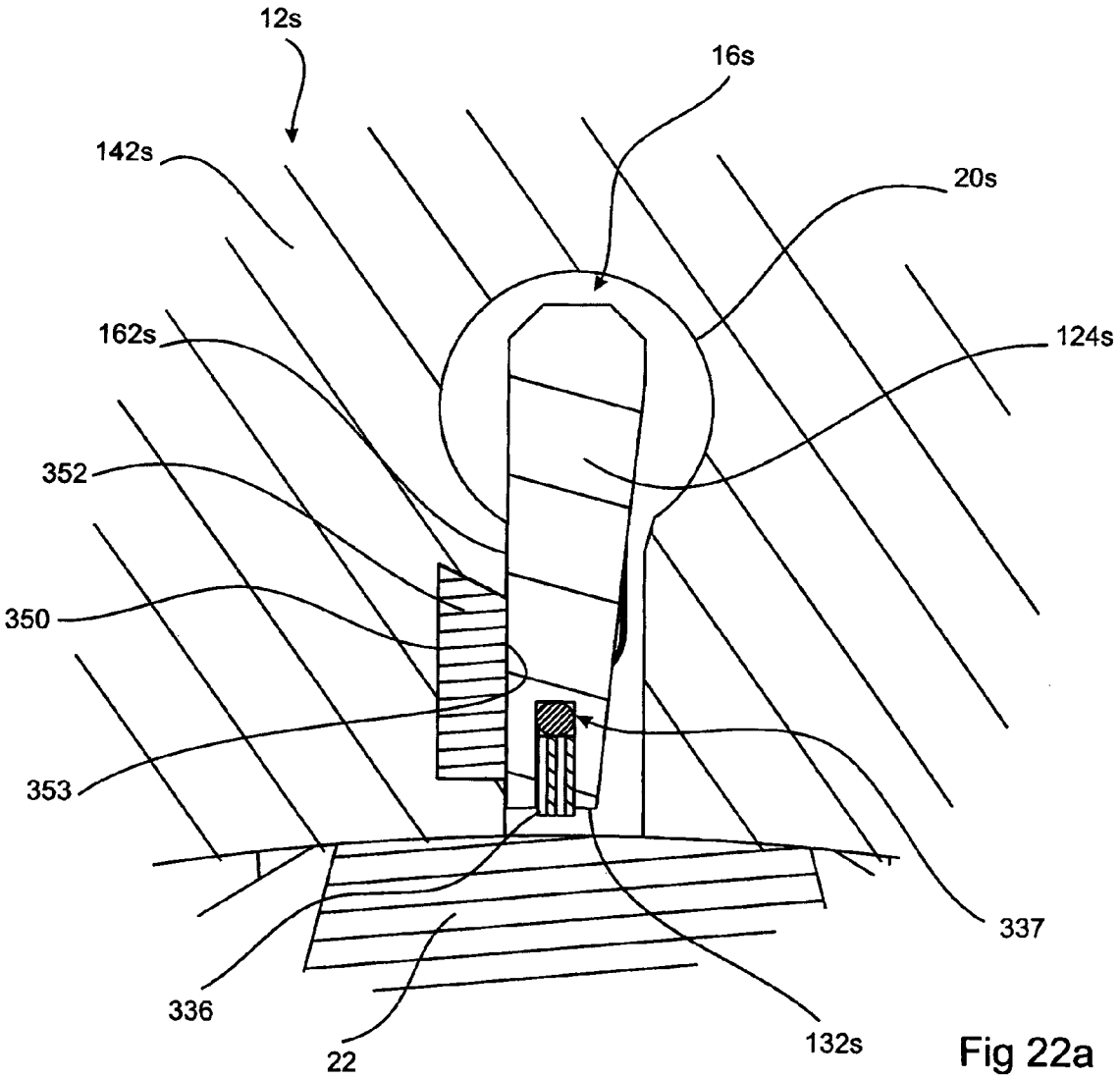
FIG. 22*a* is an enlarged portion of the machine shown in FIG. 16 depicting its gate in an inactive position.
Figure 22B:
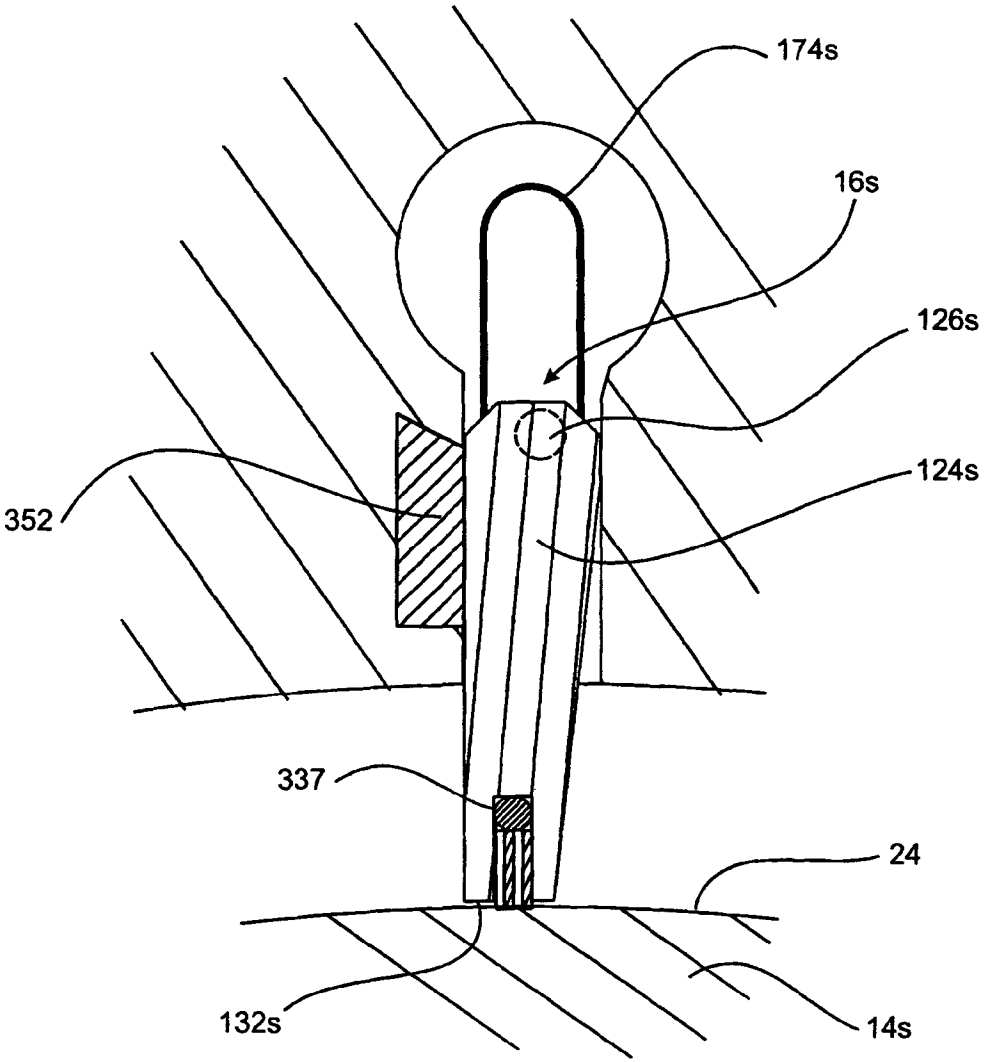
FIG. 22*b* is a view of the portion of the machine shown in FIG. 22*a* but with the gate in an active position.

FIGS. 22*a* and 22*b* illustrate the gate 16*s* in an inactive position and active position respectively. From these Figures it will also be apparent that the wiper 124*s* further differs from the wiper 124 in terms of its cross-sectional shape. Specifically, the gate 124*s* tapers so as to reduce in thickness in a direction from its pins 126*s* to the surface 132*s*. These Figures also illustrate a half dovetail slot 350 in slot 20*s* for seating a sealing strip 352. The sealing strip 352 has a sealing face 353 flush with wall 162*s* of the slot 20*s*.

In the inactive position the gate 16*s* is radially aligned with a lobe 22 which in turn is in contact with the inner circumferential surface of the rotor 12*s* on opposite sides of the slot 20*s*. When in this configuration the gate 16*s* is in an uplifted position by virtue of the action of the links 128*s* and cooperating cam ring 106*s*. As shown in FIG. 22*a*, the sealing bands 336 are lifted from the lobes 22.

FIG. 22*b* illustrates the gate 16*s* in an active position where it seals against the circumferential surface 24 of stator 14*s*. In this position the wiper 124*s* is moved radially toward the surface 24 by action of the links 128*s* and cam rings 106*s*. The gate 16*s* is brought to a position where the outer peripheral edges of the sealing bands 336 contact the surface 24*s*. While the planar surface 132*s* of the wiper 124*s* is marginally spaced from the surface 24*s*, the sealing bands 336 are positioned to contact with the surface 24*s* by action of the bias mechanism 337. Moreover, the sealing system 334 is in effect a floating mechanical sealing system maintaining contact with the surface 24*s* while allowing axial displacement between the rotor 14*s* and stator 12*s* arising from engineering tolerances in the manufacture of the machine 10.

When in the active position the wiper 124*s* also contacts and seals against the sealing strip 352. This prevents fluid from the high pressure side (in this instance on the right hand side of the gate 16*s* in FIG. 22*b*) from leaking into the low pressure side. The seal is affected by the contact between the sealing strip 352 and a surface of the wiper 124*s* together with a tilting of the gate 16*s* by action of the high pressure fluid acting on the portion of the wiper 124*s* within the working chamber. This applies a torque to the gate 16*s* in a clockwise direction about the pins 126*s*.

As a gate 16*s* transitions between the active and inactive positions (i.e. as the gate 16*s* moves further into slot 20*s*) the channels 135*s* allow fluid above the gate 16*s* in the slot 20*s* to flow past the wiper 124*s* into the working chamber. This assists in minimising the risk of hydraulically locking the gates 16*s*.

Figure 23A:
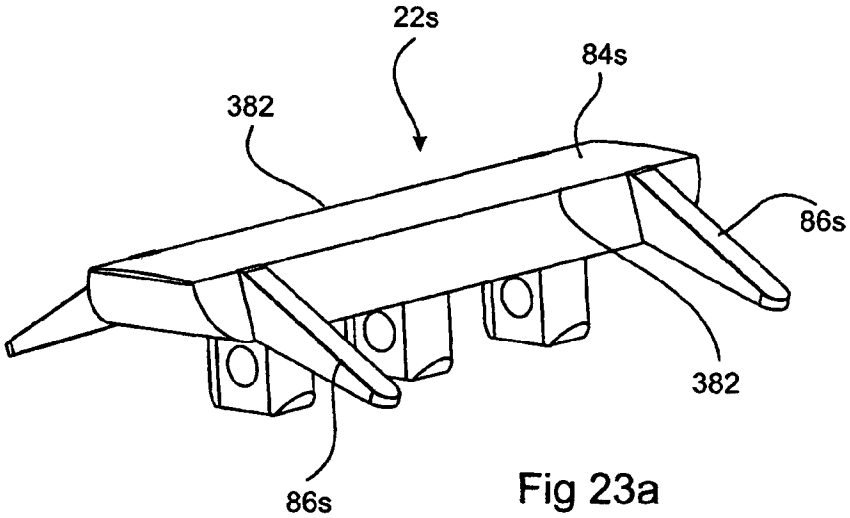
FIG. 23*a* is an isometric view of a lobe incorporated in the machine shown in FIG. 16.
Figure 23C:
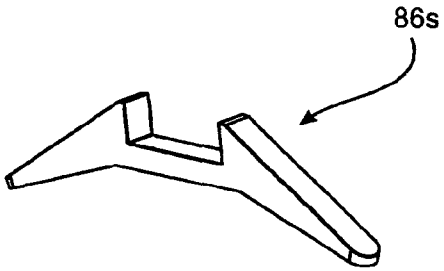
FIG. 23*c* is an isometric view of an arm incorporated in lobe shown in FIG. 23*a;*
Figure 23B:
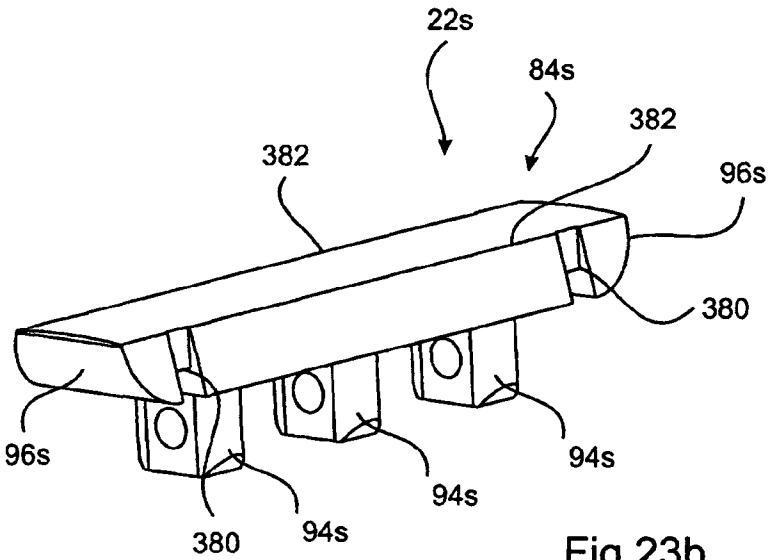
FIG. 23*b* is an isometric view of a central portion of the lobe shown in FIG. 23*a;*
Figure 24B:
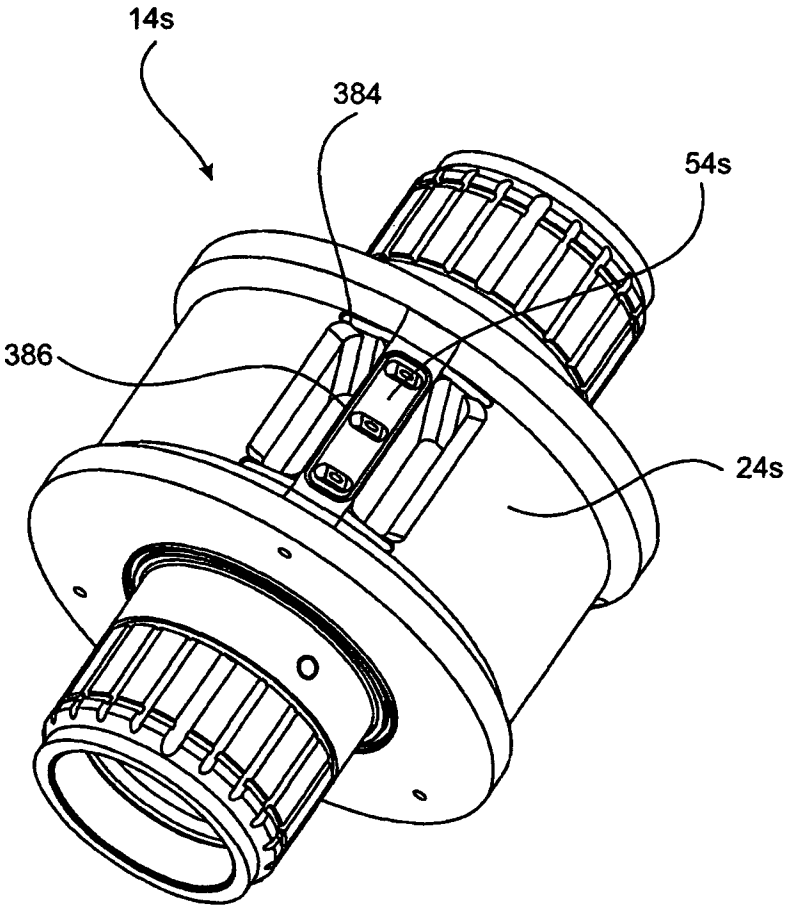
FIG. 24*b* is an isometric view of the stator shown in FIG. 24*a* but with the lobe removed.
Figure 24A:
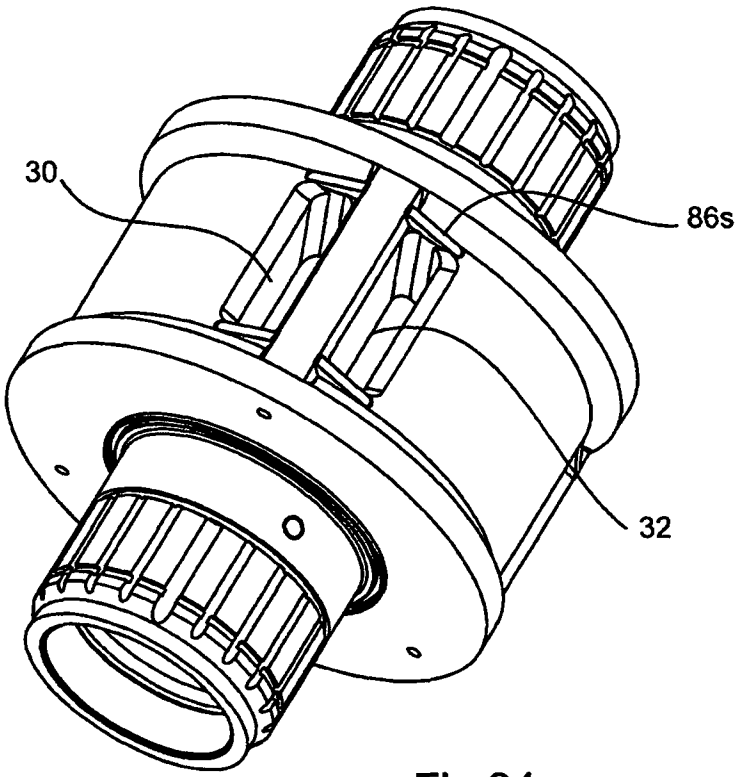
FIG. 24*a* is an isometric view of a stator of the machine shown in FIG. 16 with a fitted lobe.
Figure 25A:
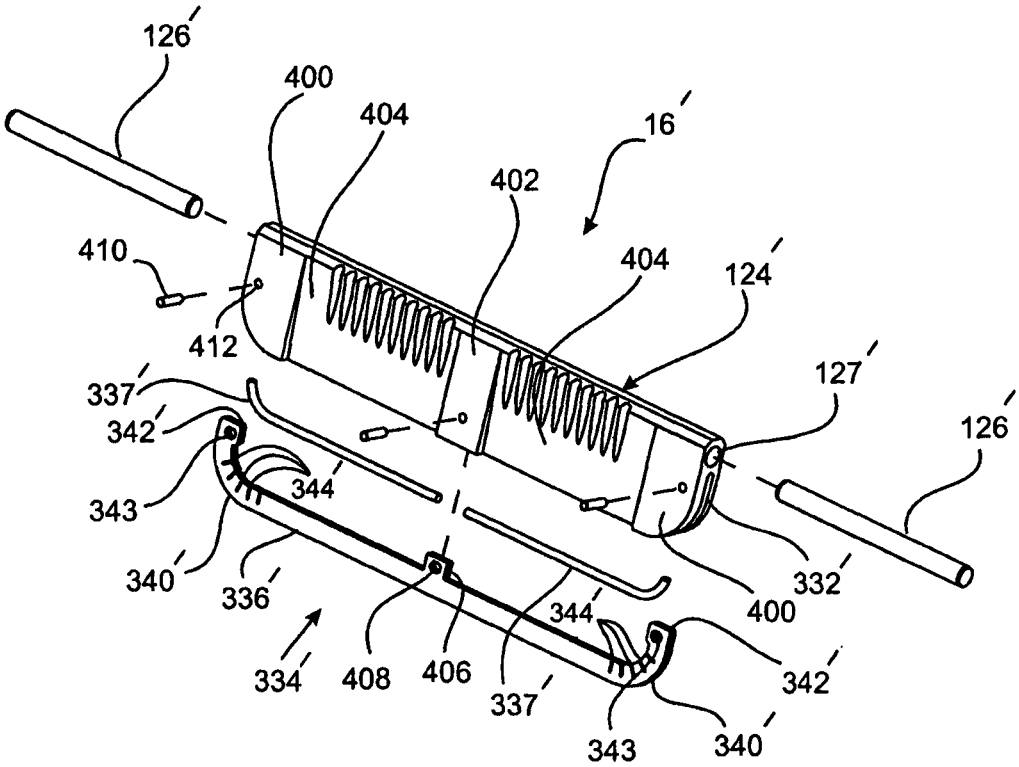
FIG. 25*a* is an exploded view of an alternate form of gate that may be incorporated in other embodiments of the machine.
Figure 25B:
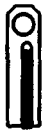
FIG. 25*b* is a side view of the gate shown in FIG. 25*a;*
Figure 25C:
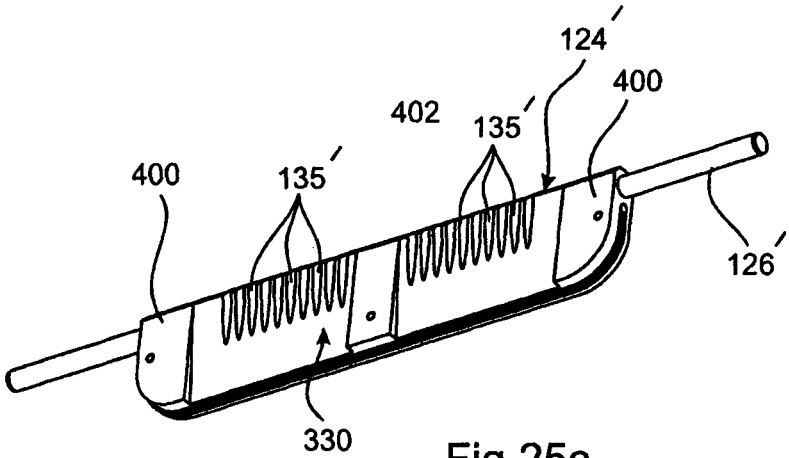
FIG. 25*c* is an isometric view of the gate shown in FIG. 25*a;*

FIGS. 23*a*-23*c* depict an alternate form of lobe 22*s* which is incorporated in the machine 10*s*. The substantive difference between the lobe 22*s* and the lobe 22 resides in the location and configuration of the ramps 86 and the configuration of central portion 84*s*. The ramps 86*s* and central portion 84*s* are made as separate components which are interfitted when assembled on the machine 10*s*. The central portion 84*s* has a generally similar configuration to the portion 84 with the main differences being the provision of slots 380 to receive the legs 86*s*, and the squaring of the upper edges 382. In contrast in the machine 10, the lobes 22 are formed with sloping or cambered longitudinal edges. The ramps 86*s* are located nearer the longitudinal ends of the central portion 84*s* so that when the lobe 22*s* is fitted onto the stator 14*s* (as shown in FIG. 24*a*) the ramps 86*s* do not bridge across the ports 30 and 32. Rather the ramps 86*s* extend across the outer circumferential surface 24*s* at locations beyond the axial ends of the ports 30 and 32. Additionally, as shown most clearly in FIG. 24*b*, recessed slots 384 are formed in the surface 24*s* of stator 14*s* for receiving the respective ramps 86*s*. Also, an endless groove 386 is formed in a land 54*s* for receiving an O-ring (not shown) to act as a seal between the lobe 22*s* and the land 84*s*.

FIGS. 25*a*-26*b* illustrate a further possible configuration of gates 16' that may be incorporated in alternate embodiments of the rotary fluid machine. The gate 16' differs in several respects to the gate 16*s* shown in FIGS. 20*a*-21*b*. Gate 16' comprises a wiper 124' pin provided with respective holes 127' formed at opposite ends to receive respective pins 126'. Wiper 124' is formed with: thickened ribs 400 at opposite ends and extending in a radial direction: and, a central thickened rib 402. The side surface 330' between the ribs 400 and 402 is tapered and provided with channels 135' as in the wiper 124*s*.

The gate 16' is also formed with a recess 332' for seating a gate seal system 334'. The gate seal system 334' comprises: one or more sealing bands 336'; and, biasing elements 337' which in this embodiment are in the form of lengths of resilient material such as but not limited to rubber. The biasing elements 337' are seated within grooves (not shown) formed within the wiper 124'.

Each sealing band 336' is formed at opposite ends with integral pegs 342' similar to the pegs 342 of the gates 16*s*. However in the gates 16', each peg 342' is formed with a through hole 343. Additionally, the sealing band 336' is formed with a central tab 406 which is also formed with a through hole 408. Each sealing band 336' is held within the recess 332' by pins 410 which pass through holes 412 formed in the ribs 400 and 402 as well as through the holes 343 and 406.

The sealing bands 336' are formed with slots 334' but only in the vicinity of the end curved portions 340'. This provides a degree of flexibility enabling the curved portions 340' to flex inwardly or outwardly in the plane containing the sealing band 336'. However the ability for the sealing band 336' to move radially and axially is provided by the pins 410 in holes 343 and 406. Specifically, the holes 343 and 406 are formed of a greater diameter than the pins 410. This provides a degree of clearance between the pins 410 and the circumferential surfaces of the holes 343 and 406.

Figure 26A:
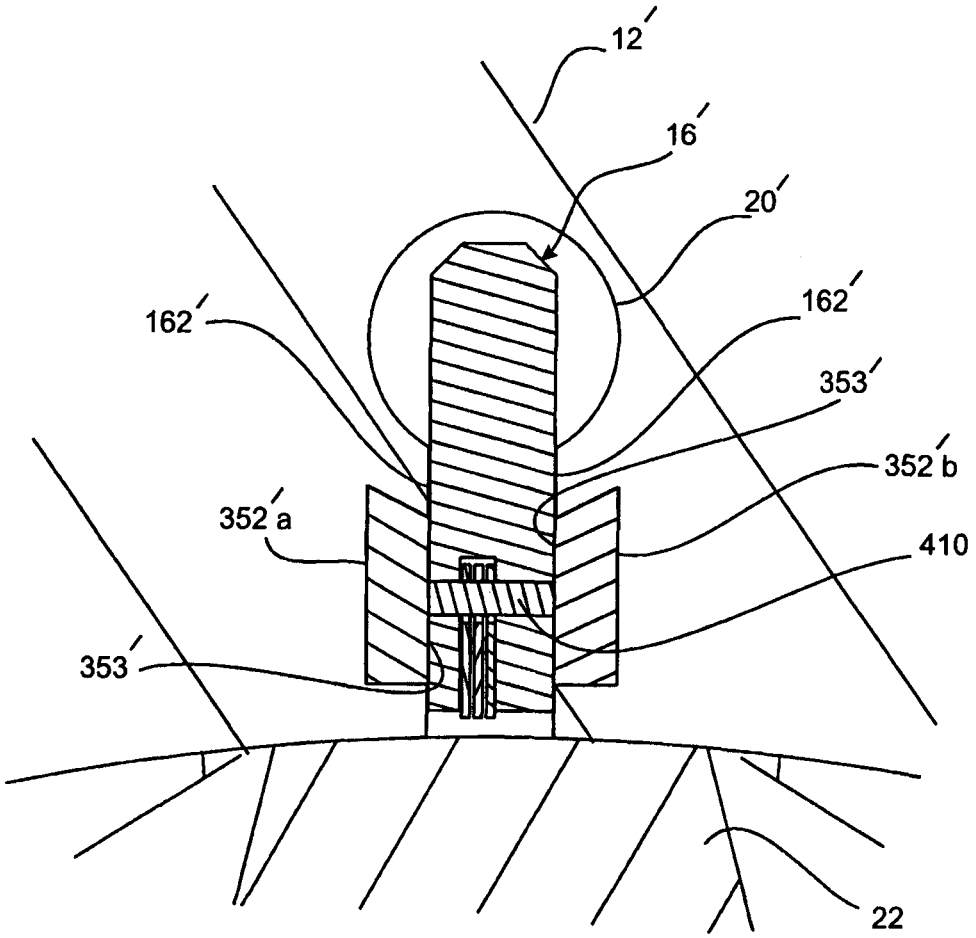
FIG. 26*a* is an enlarged view of a portion of an embodiment of the machine incorporating the gate shown in FIG. 25*a* when in an inactive position; and, FIG. 26*b* is a view of the portion of the machine shown in FIG. 26*a* but with the gate now in an active position.
Figure 26B:
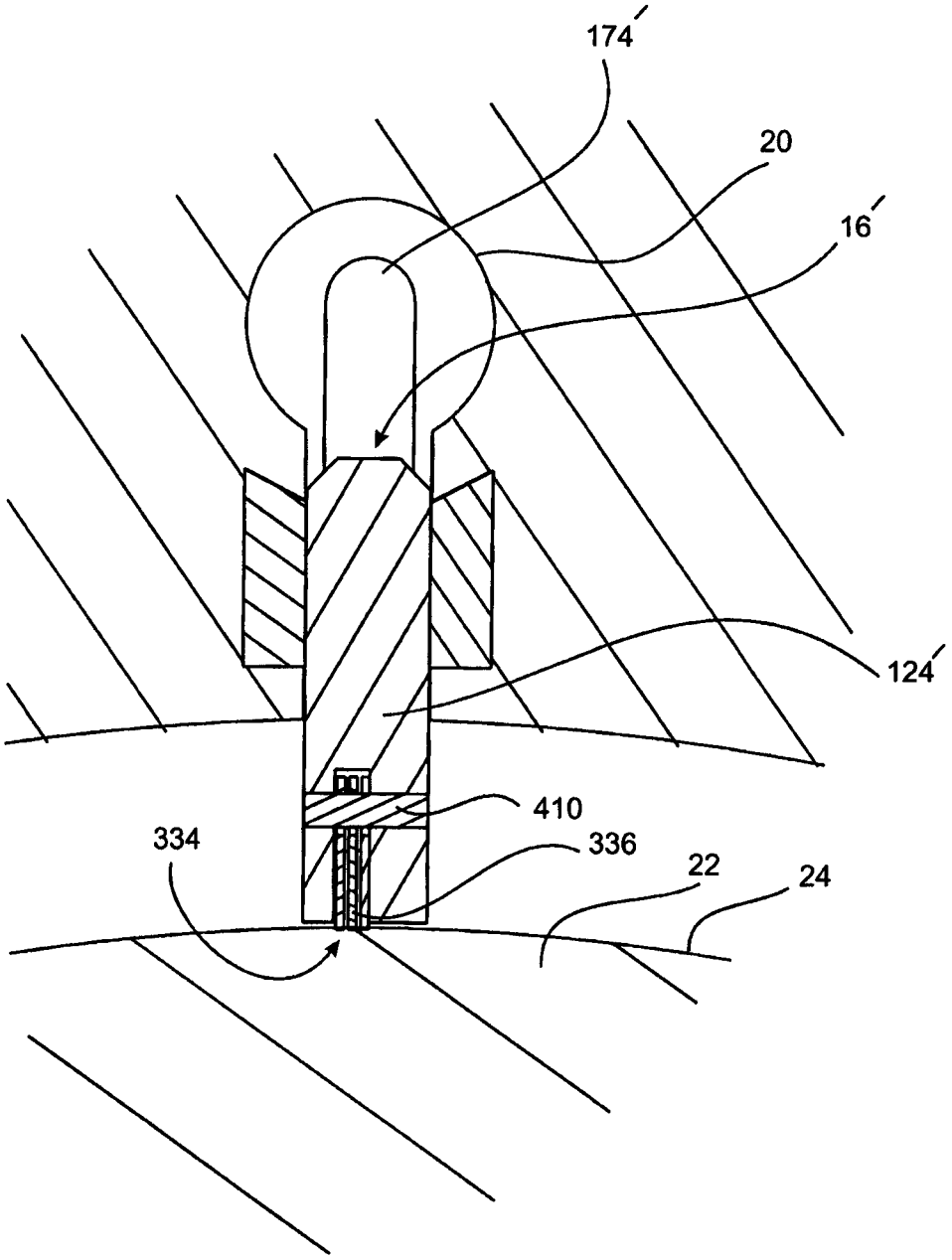

FIGS. 26*a* and 26*b* depict the operation of the gate 16' when in the inactive and active positions respectively, which is the same as for the gates 16*s*. However when using the gates 16', the rotor 12' is provided with two sealing strips 352'*a* and 352'*b* one in each of the walls 162' of each slot 20'. The sealing strips 352'*a* and 352'*b* are diametrically opposed from each other and engage in respective dovetail slots 350'. The sealing strip 352'*a* has a sealing face 353'*a* which is flush with the wall 162' in which it is seated and contacts the back face of wiper 124'. The sealing strip 352'*b* has a sealing face 353'*b* which is flush with the wall 162' in which it is seated and contacts the surface of ribs 400 and 402. However fluid is able to flow through the slots 135' on the tapered side surface 330' between the ribs 400 and 402.

Now that an embodiment of the invention has been described in detail it will be apparent to those skilled in the relevant arts that numerous modifications and variations may be made without departing from the basic inventive concepts. In particular, it is envisaged that the sealing system described herein above may be varied to provide alternate sealing mechanisms and/or pressure balancing which assists in sealing and maintaining of seals.

It will be further understood by those skilled in the art that other modifications and variations may be made to the machine 10. For example in the illustrated embodiment, the stator 14 is illustrated as being provided with one hub 42. However a number of co-axial hubs 42 may be formed on the stator 14. A separate rotor may then be mounted on that hub to in effect provide two machines on a single stator 14. The fluid flowing out of a first machine is used as the fluid source for the next machine. Also two types of gate seal system 334*s* and 334' are described each incorporating different types of sealing bands 336. The illustrated sealing band each has a number of slots 344 although arranged differently in terms of location. It is envisaged that in alternate embodiments the sealing bands could be made without any slots 344 by appropriate selection of the material from which the sealing band are made. In yet a further variation, slots 344 in the straight length 338 of sealing bands may be orientated parallel to the straight length 338, rather than transverse as currently depicted in FIG. 21 *b*. Additionally, the different variations and/or modifications described of various features or components that are common to the different embodiments can be interchangeably used and not limited to any specific embodiment. For example any of gates the 16, 16*s* and 16' may be incorporated in machines 10 and 10*s*; similarly either of lobes 22 or 22*s* may be incorporated in machines 10 and 10*s*. All such modifications and variations together with others that will be obvious to persons or ordinary skill in the art are deemed to be within the scope of the present invention the nature of which is to be determined from the above description and the appended claims.

The invention claimed is:

1. A rotary fluid machine comprising:

first and second bodies, the bodies being rotatable relative to each other through at least 360° and arranged one inside the other to define at least one working chamber there between;

at least one gate supported by the first body, each gate having: a planar axial surface and respective rounded corners at each end of the axial surface;

the second body comprising a circumferential surface forming a surface of the working chamber, the circumferential surface having an intermediate surface extending in an axial direction and contiguous curved surfaces on each side of the intermediate surface and extending in a radial direction to form with the intermediate surface a U shaped channel, wherein when the planar axial surface is adjacent the intermediate surface, the rounded corners and the curved surfaces lie closely adjacent to and substantially parallel with each other to form a tolerance gap between the at least one gate and the circumferential surface.

2. The rotary fluid machine according to claim 1 wherein each of the curved surfaces and the rounded corners smoothly curve through 90 degrees.

3. The rotary fluid machine according to claim 2 wherein the rounded corners of the gate are convexly curved and the curved surfaces of the second body are concavely curved.

4. The rotary fluid machine according to claim 1 wherein the or each gate comprises a wiper and a gate seal system supported by the wiper, the gate seal system arranged to form a dynamic seal against the circumferential surface of the second body.

5. The rotary fluid machine according to claim 4 wherein the wiper is provided with the planar axial surface and the respective rounded corners and the gate seal system comprises one or more sealing bands supported in the wiper and extendable from the planar axial surface and respective rounded corners.

6. The rotary fluid machine according to claim 5 wherein the or each sealing band is resilient biased to extend from the planar axial surface and respective rounded corners.

7. The rotary fluid machine according to claim 5 wherein the or each sealing band is axially and radially movable relative to the wiper.

8. The rotary fluid machine according to claim 5 wherein each sealing band comprise a straight length and curved portions at each end of the straight length, and a plurality of slots formed in the curved portions to facilitate flexing of the curved portions in a plane containing a corresponding sealing band.

9. The rotary fluid machine according to claim 8 wherein each sealing band comprises a plurality of slots formed in the straight length.

10. The rotary fluid machine according to claim 5 wherein the gate seal system comprise at least two sealing bands juxtaposed face to face, each sealing band being provided with a plurality of slots to facilitate flexing of the sealing bands, and wherein the sealing bands and slots are arranged so that there is no direct fluid flow path between opposite sides of the gate seal system through the slots.

11. The rotary fluid machine according to claim 1 wherein each gate is provided with one or more radially extending channels to enable fluid flow between radially opposite ends of the gate.

12. The rotary fluid machine according to claim 11 wherein the radially extending channels extend through the gate and open onto the radially opposite ends of the gate.

13. The rotary fluid machine according to claim 1 comprising a gate displacement system operable to displace the gate in a radial direction upon rotation of the first body relative to the second body;

wherein the gate displacement system comprises for each gate, two gate links coupled one on each side of the gate, and cam surfaces arranged to guide the gate links to move in the radial direction as the first and second bodies rotate relative to each other, the gate links and the cam surfaces being disposed outside of the working chamber.

14. The rotary fluid machine according to claim 13 wherein each gate link comprises two cam followers arranged to engage respective cam surfaces, and wherein each gate link is slidably retained within the first body and coupled by a pin to a corresponding gate.

15. The rotary fluid machine according to claim 14 wherein the first body comprises a radially extending pin slot for each pin, each pin extending axially through a corresponding pin slot to couple with a corresponding link, and a pin slot sealing arrangement operable to form a substantially seal about the pin slot.

16. The rotary fluid machine according to claim 15 wherein the first body is provided with a link recess for each link, each link recess being formed inboard of a radially inner most and a radially outer most edge of the first body, wherein each link is slidably retained in a respective link recess.

17. The rotary fluid machine according to claim 16 wherein two cam followers are rotatable coupled on respective axles on a same side of the link.

18. The rotary fluid machine according to claim 17 wherein the pin slot sealing arrangement comprises first and second seal plates arranged face to face wherein the first seal plate is coupled to and moves with the link, the first seal plate further provided with a hole through which the pin extends; and the second seal plate is coupled to and fixed relative to the first body, the second seal plate being provided with a slot being in registration with a respective pin slot formed in the first body.

19. The rotary fluid machine according to claim 13 the wherein the first body comprises an intermediate housing provided with a plurality of blind gate slots within which respective gates reciprocate, each gate slot comprising two spaced apart and parallel flat surfaces which face each other and extend at one end to an inner circumferential surface of the intermediate housing, and a contiguous arcuate portion extending between respective distant ends of the flat surfaces forming a blind end of the gate slot.

20. The rotary fluid machine according to claim 1 wherein the second body comprises one or more pairs of ports, each pair of ports comprising a fluid inlet port and a fluid outlet port with the inlet port and the outlet port each having a bevelled surface that slopes radially inward of the circumferential surface and, one or more lobes demountable coupled to the second body and configured to project from the circumferential surface of the second body, each lobe: located between the inlet and outlet ports in a pair of ports; and, comprising a central portion and at least one ramp extending from each side of the central portion to the circumferential surface, the at least one ramp having a free end and a ramp surface, the free end having a surface that is beveled and abuts the beveled surface of an inlet port or an outlet port at a location radial inward of the circumferential surface wherein the ramp surface provides a transition between the circumferential surface to an upper surface of the central portion.

21. A rotary fluid machine comprising:

first and second bodies, the bodies being rotatable relative to each other and arranged one inside the other to define at least one working chamber there between;

at least one gate supported by the first body, each gate having: a planar axial surface and respective rounded corners at each end of the axial surface;

the second body comprising a circumferential surface forming a surface of the working chamber, the circumferential surface having an intermediate surface extending in an axial direction and contiguous curved surfaces on each side of the intermediate surface and extending in a radial direction to form with the intermediate surface a U shaped channel, wherein when the planar axial surface is adjacent the intermediate surface, the rounded corners and the curved surfaces lie closely adjacent to and substantially parallel with each other;

wherein the or each gate comprises a wiper and a gate seal system supported by the wiper, the gate seal system arranged to form a dynamic seal against the circumferential surface of the second body;

wherein the wiper is provided with the planar axial surface and the respective rounded corners and the gate seal system comprises one or more sealing bands supported in the wiper and extendable from the planar axial surface and respective rounded corners; and wherein each sealing band comprise a straight length and curved portions at each end of the straight length, and a plurality of slots formed in the curved portions to facilitate flexing of the curved portions in a plane containing a corresponding sealing band.

22. The rotary fluid machine according to claim 21 wherein each sealing band comprises a plurality of slots formed in the straight length.

23. A rotary fluid machine comprising:

first and second bodies, the bodies being rotatable relative to each other and arranged one inside the other to define at least one working chamber there between;

at least one gate supported by the first body, each gate having: a planar axial surface and respective rounded corners at each end of the axial surface;

the second body comprising a circumferential surface forming a surface of the working chamber, the circumferential surface having an intermediate surface extending in an axial direction and contiguous curved surfaces on each side of the intermediate surface and extending in a radial direction to form with the intermediate surface a U shaped channel, wherein when the planar axial surface is adjacent the intermediate surface, the rounded corners and the curved surfaces lie closely adjacent to and substantially parallel with each other;

the rotary fluid machine further comprising a gate displacement system operable to displace the gate in a radial direction upon rotation of the first body relative to the second body;

wherein the gate displacement system comprises for each gate, two gate links coupled one on each side of the gate, and cam surfaces arranged to guide the gate links to move in the radial direction as the first and second bodies rotate relative to each other, the gate links and the cam surfaces being disposed outside of the working chamber;

wherein each gate link comprises two cam followers arranged to engage respective cam surfaces, and wherein each gate link is slidably retained within the first body and coupled by a pin to a corresponding gate; and wherein the first body comprises a radially extending pin slot for each pin, each pin extending axially through a corresponding pin slot to couple with a corresponding link, and a pin slot sealing arrangement operable to form a substantially seal about the pin slot.

24. The rotary fluid machine according to claim 23 wherein the first body is provided with a link recess for each link, each link recess being formed inboard of a radially inner most and a radially outer most edge of the first body, wherein each link is slidably retained in a respective link recess.

25. The rotary fluid machine according to claim 24 wherein two cam followers are rotatable coupled on respective axles on a same side of the link.

26. The rotary fluid machine according to claim 25 wherein the pin slot sealing arrangement comprises first and second seal plates arranged face to face wherein the first seal plate is coupled to and moves with the link, the first seal plate further provided with a hole through which the pin extends; and the second seal plate is coupled to and fixed relative to the first body, the second seal plate being provided with a slot being in registration with a respective pin slot formed in the first body.

27. A rotary fluid machine comprising:

first and second bodies, the bodies being rotatable relative to each other and arranged one inside the other to define at least one working chamber there between;

at least one gate supported by the first body, each gate having: a planar axial surface and respective rounded corners at each end of the axial surface;

the second body comprising a circumferential surface forming a surface of the working chamber, the circumferential surface having an intermediate surface extending in an axial direction and contiguous curved surfaces on each side of the intermediate surface and extending in a radial direction to form with the intermediate surface a U shaped channel, wherein when the planar axial surface is adjacent the intermediate surface, the rounded corners and the curved surfaces lie closely adjacent to and substantially parallel with each other;

wherein the or each gate comprises a wiper and a gate seal system supported by the wiper, the gate seal system arranged to form a dynamic seal against the circumferential surface of the second body;

wherein the wiper is provided with the planar axial surface and the respective rounded corners and the gate seal system comprises one or more sealing bands supported in the wiper and extendable from the planar axial surface and respective rounded corners; and wherein the gate seal system comprise at least two sealing bands juxtaposed face to face, each sealing band being provided with a plurality of slots to facilitate flexing of the sealing bands, and wherein the sealing bands and slots are arranged so that there is no direct fluid flow path between opposite sides of the gate seal system through the slots.

* * * * *